US011503390B2

(12) United States Patent
Lee

(10) Patent No.: US 11,503,390 B2
(45) Date of Patent: Nov. 15, 2022

(54) SPEAKER

(71) Applicant: Nam Hae Lee, Seoul (KR)

(72) Inventor: Nam Hae Lee, Seoul (KR)

( * ) Notice: Subject to any disclaimer, the term of this patent is extended or adjusted under 35 U.S.C. 154(b) by 0 days.

(21) Appl. No.: 17/316,683

(22) Filed: May 10, 2021

(65) Prior Publication Data

US 2021/0360341 A1 Nov. 18, 2021

(30) Foreign Application Priority Data

May 14, 2020 (KR) ..... 10-2020-0057465

(51) Int. Cl.
*H04R 1/02* (2006.01)
*H04R 1/32* (2006.01)

(52) U.S. Cl.
CPC ..... *H04R 1/026* (2013.01); *H04R 1/323* (2013.01); *H04R 2201/02* (2013.01)

(58) Field of Classification Search
CPC .... H04R 1/026; H04R 1/323; H04R 2201/02; H04R 1/2853; H04R 1/2869; H04R 1/2873; H04R 1/2884; H04R 1/2888
See application file for complete search history.

(56) References Cited

U.S. PATENT DOCUMENTS 8,256,566 B1 * 9/2012 Rodgers ..... H04R 1/2826 381/345

FOREIGN PATENT DOCUMENTS

| | | | |
|---|---|---|---|
| JP | 2009147892 | A | 7/2009 |
| JP | 2010068116 | A | 3/2010 |
| JP | 2017085364 | A | 5/2017 |
| KR | 20100091185 | A | 8/2010 |
| KR | 101337553 | B1 | 12/2013 |

* cited by examiner

*Primary Examiner* — Kile O Blair
(74) *Attorney, Agent, or Firm* — Renaissance IP Law Group LLP

(57) ABSTRACT

Disclosed herein is a speaker. The speaker includes: an enclosure provided in a rectangular parallelepiped shape; a speaker unit mounted on at least one face of the enclosure; and a partition provided inside the enclosure and partitioning a space, wherein the partition divides a space inside the enclosure, and a space starting from the speaker unit has an asymmetrical cross section of a tunnel structure.

10 Claims, 31 Drawing Sheets

SPEAKER

BACKGROUND

1. Field

The present disclosure relates to a speaker, and more particularly, to a speaker capable of increasing a quality of sound by including a speaker enclosure having an internal space with an asymmetric cross section.

2. Description of Related Art

In general, a speaker includes a speaker unit converting an electrical signal into an aerodynamic signal and an enclosure accommodating the speaker unit therein and determining a quality of most of the sound.

Such a speaker may be mainly classified into a sealed speaker and a duct-type speaker according to a type of enclosure. The sealed speaker is a speaker generating a sound only with a sound wave generated from a front face of a speaker unit by having a structure in which an inner portion of an enclosure is completely sealed, while the duct-type speaker is a speaker improving particularly characteristics of a low range by including a duct provided in an enclosure so as to be in communication with an inner portion of the enclosure to invert a phase of a sound wave generated from a rear face of a cone of a speaker unit and discharge the source wave whose phase is inverted to the outside of the enclosure.

As described above, the enclosure of the speaker does not simply serve as a case accommodating the speaker unit therein, but serves to reflect and attenuate a sound wave generated from the speaker unit, and thus, is a component as important as the speaker unit in the speaker.

As illustrated in FIGS. 1A and 1B, the inner portion of the enclosure according to the related art is formed in a symmetrical shape, such that a sound coming out to a rear face of a speaker unit is reflected in a simple form on an inner wall of the enclosure and a reflected wave of a specific frequency is abnormally increased, and thus, a sound whose quality is deteriorated finally comes out from the speaker. Therefore, a space inside the speaker may be efficiently disposed using the speaker unit as a starting point.

SUMMARY

The present disclosure has been made in order to solve the demand and the necessity as described above, and an object of the present disclosure is to provide a speaker that suppresses an abnormal increase in a reflected wave of a specific frequency, evenly disperses reflection of a sound pressure up to a long distance, and reducing distorted reflection of a sound by including a speaker enclosure having an internal space with an asymmetric cross section.

According to an embodiment of the present disclosure, a speaker includes: an enclosure provided in a rectangular parallelepiped shape; a speaker unit mounted on at least one face of the enclosure; and a partition provided inside the enclosure and partitioning a space, wherein the partition divides a space inside the enclosure, and a space starting from the speaker unit is formed to have a space having an asymmetrical cross section of a tunnel structure.

DETAILED DESCRIPTION

Figure 1A:
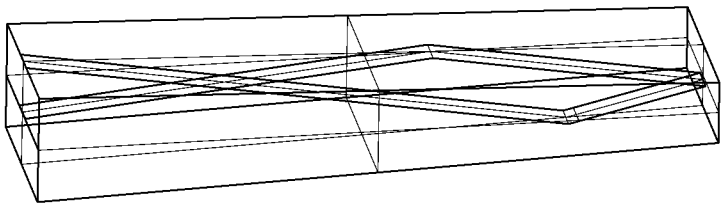
FIGS. 1A and 1B are conceptual diagrams of a speaker enclosure according to the related art.
Figure 1B:
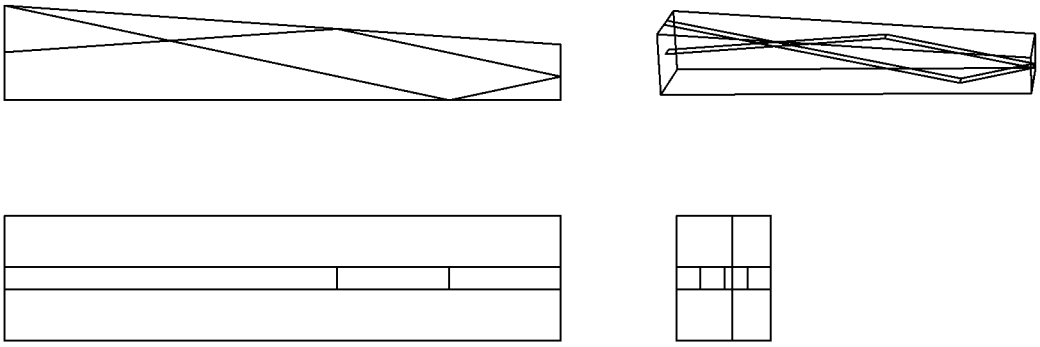

Hereinafter, embodiments of the present disclosure will be described in detail with reference to the accompanying drawings so that they may be easily practiced by those skilled in the art to which the present disclosure pertains.

However, the present disclosure may be implemented in various different forms, and is not limited to embodiments described herein. In addition, in the drawings, portions unrelated to the description will be omitted in order to obviously describe the present disclosure, and similar portions will be denoted by similar reference numerals throughout the specification.

Throughout the specification, "including" any component will be understood to imply the inclusion of other components rather than the exclusion of other components unless explicitly described to the contrary.

Hereinafter, speakers according to embodiments of the present disclosure will be described in detail with reference to the drawings.

A speaker according to the present disclosure includes an enclosure provided in a hexahedral shape, a speaker unit mounted on at least one face of the enclosure, and a partition provided inside the enclosure and partitioning a space. The partition divides the space inside the enclosure, and a space starting from the speaker unit continuously maintains an asymmetric cross-sectional structure as a space having an asymmetric cross section of a tunnel structure. A space inside the speaker according to the present disclosure is continuously provided in an asymmetric cross-sectional structure, and a case where a cross-sectional area of the space inside the speaker is gradually decreased has been illustrated in an embodiment of the present disclosure, but the cross-sectional area of the space inside the speaker is not limited thereto, and may be provided to be increased, may be provided to be increased and then decreased, or may be provided to be decreased and then increased.

A case where the enclosure is provided in a shape in which a length thereof in a vertical direction is large has been illustrated, but the enclosure may be provided a shape in which a length thereof in a horizontal direction is larger, a cubic shape, or a rectangular parallelepiped shape or may be disposed so that one face thereof is inclined. When the enclosure is provided in the rectangular parallelepiped shape, six faces of the enclosure are referred to as a top face portion, a bottom face portion, a front face portion, a rear face portion, a left face portion, and a right face portion.

The speaker unit may be disposed on any one of the top face portion, the front face portion, the rear face portion, and the left face portion, and may be disposed in various options according to a shape of an interior space in which the speaker is to be mounted and a structure of the space in which the speaker is to be disposed.

The enclosure according to the present disclosure may be applied to a general home speaker, an event speaker, an audio speaker, an earphone or headphone speaker, a vehicle speaker, and a speaker combined with other electronic devices, but the types of speakers to which the enclosure according to the present disclosure is applied are not limited thereto.

It may be confirmed through FIGS. 2A to 4C that an inner portion of the speaker according to the present disclosure is formed continuously asymmetrically in a tunnel shape, and spaces between a side face and a partition and between partitions of the enclosure are formed asymmetrically.

Figure 2A:
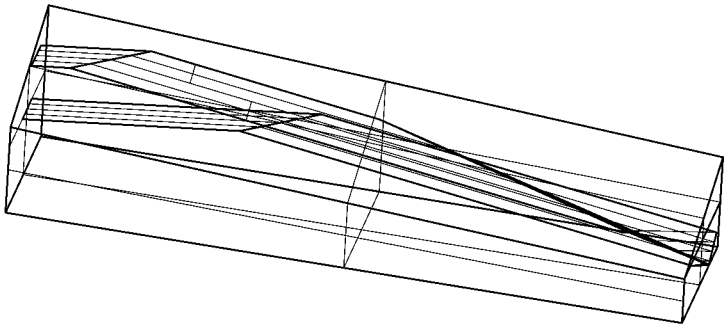
FIGS. 2A and 2B are conceptual diagrams of a speaker enclosure according to present disclosure.
Figure 2B:
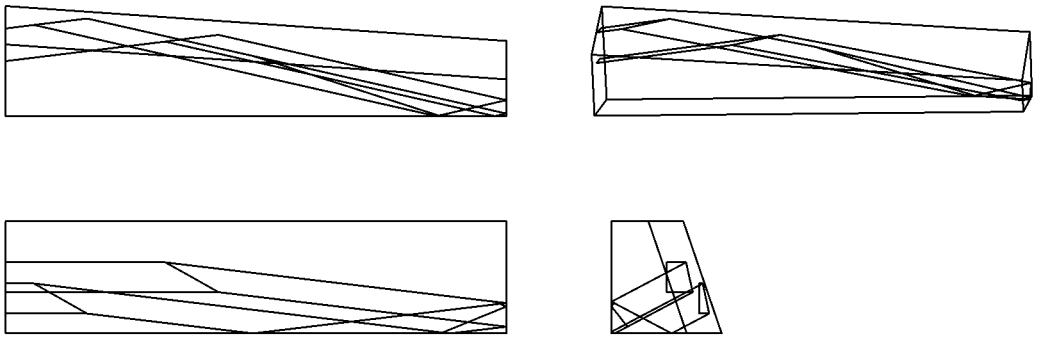

FIGS. 2A and 2B are conceptual diagrams of a speaker enclosure according to present disclosure. Referring to FIGS. 2A and 2B, the speaker enclosure according to the present disclosure has a structure in which a cross-sectional area inside the enclosure is gradually decreased, and all cross sections of the enclosure are provided as asymmetric cross sections.

That is, unlike the related art in which all cross-sectional areas are formed as symmetrical cross sections even in a case where cross-sectional areas decrease from the speaker unit, in the speaker enclosure according to the present disclosure, cross sections from the speaker unit are provided as asymmetrical cross sections. As an example, the cross-sectional areas gradually decrease, and the cross sections are provided as the asymmetrical cross sections. Therefore, the speaker enclosure according to the present disclosure has a complicated reflection model including vertical reflection and horizontal reflection as compared with the related art that maintains only simple vertical reflection, suppresses an abnormal increase in a reflected wave of a specific frequency at which a specific reflection distance from the speaker unit is created, and evenly disperses reflection of a sound pressure (sound wave) up to a long distance.

Figure 3A:
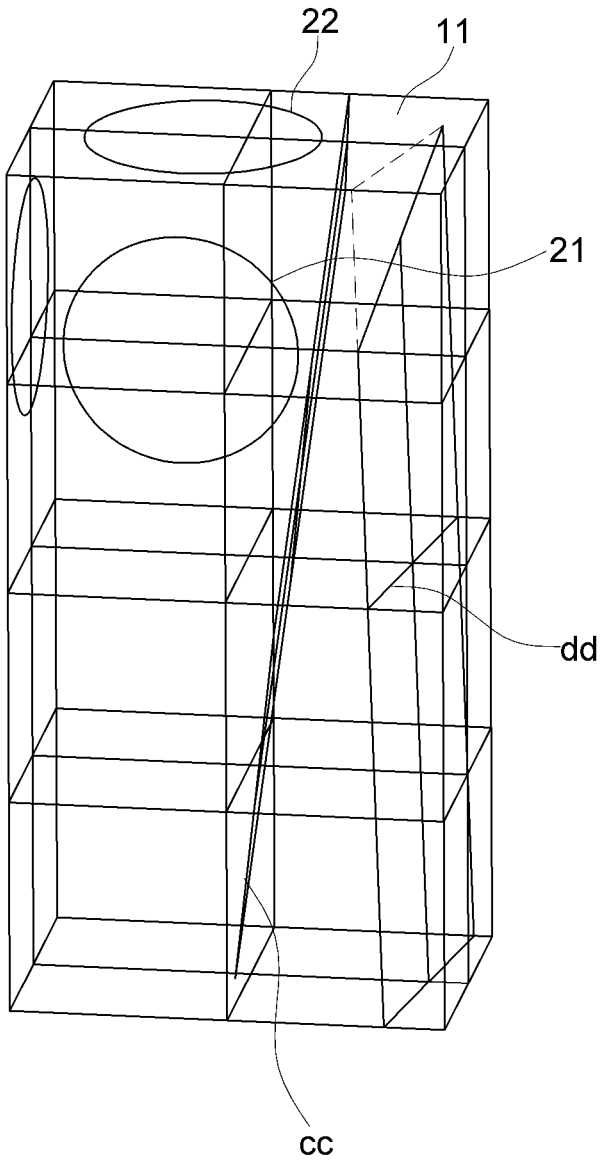
FIGS. 3A and 3B are first schematic diagrams illustrating partitions partitioning spaces inside the speaker enclosure according to the present disclosure.
Figure 3B:
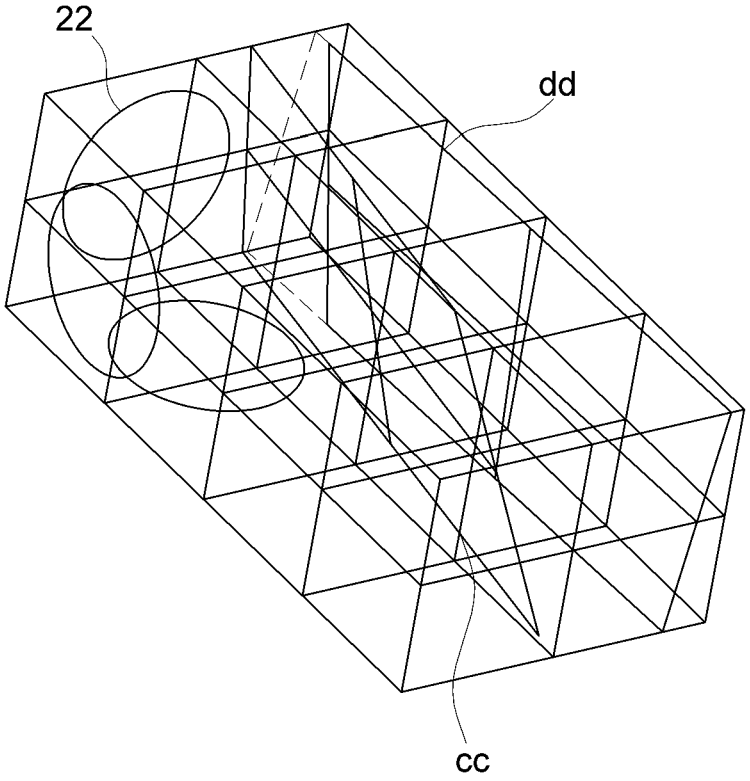
Figure 3C:
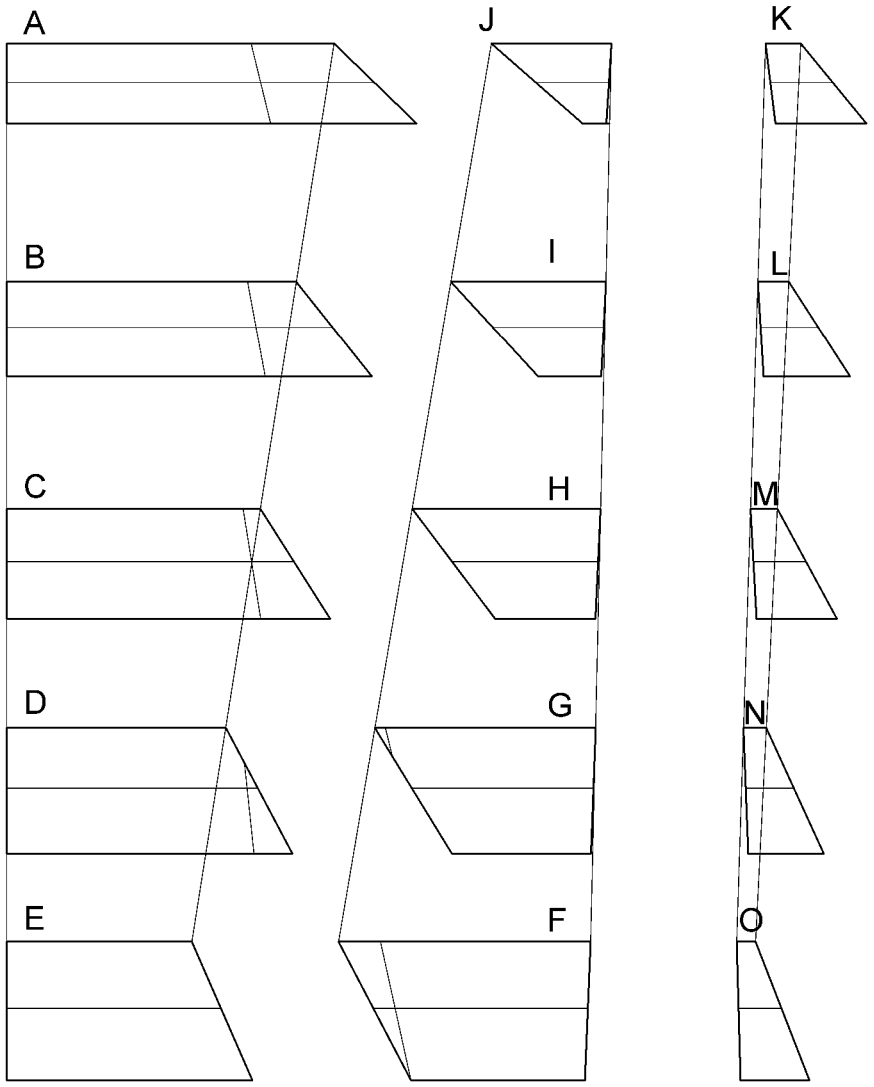
FIG. 3C is a conceptual diagram illustrating that the spaces are partitioned according to the partitions of FIGS. 3A and 3B.
Figure 3D:
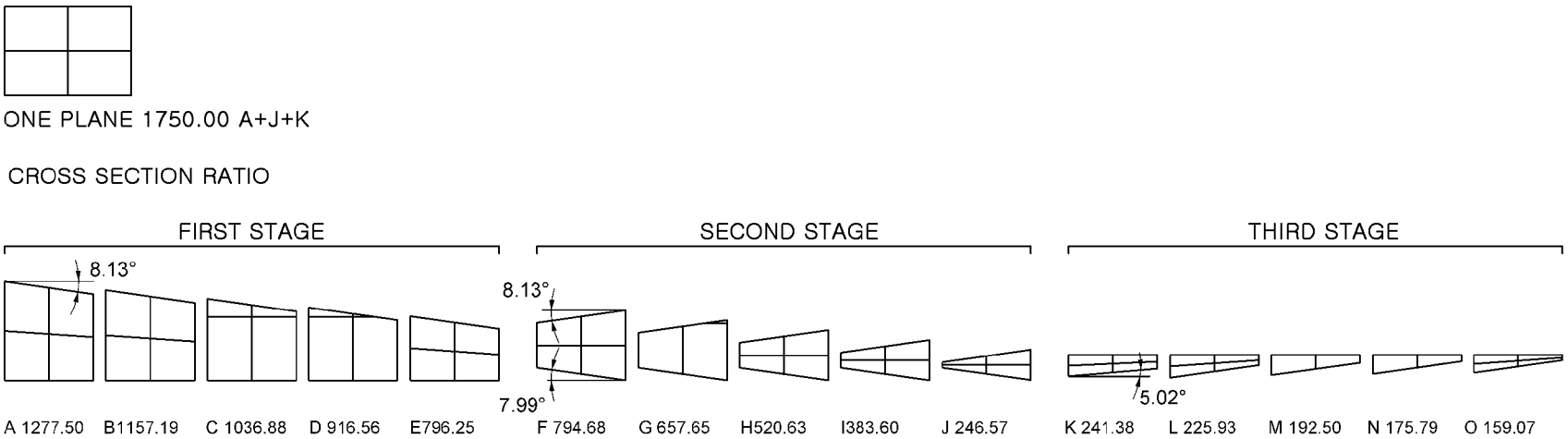
FIG. 3D is a conceptual diagram illustrating the partitioned spaces of FIG. 3C as cross-sectional areas.

FIGS. 3A and 3B are first schematic diagrams illustrating partitions partitioning spaces inside the speaker enclosure according to the present disclosure, FIG. 3C is a conceptual diagram illustrating that the spaces are partitioned according to the partitions of FIGS. 3A and 3B, and FIG. 3D is a conceptual diagram illustrating the partitioned spaces of FIG. 3C as cross-sectional areas.

Referring to FIG. 3A, a second speaker unit 22 may be disposed on a top face portion 11 of the enclosure, and another speaker unit may be disposed on a side portion of the enclosure. Inside the enclosure adjacent to the speaker units, a first partition cc is disposed in a vertical direction so as to have a preset angle with respect to a length direction of the enclosure, and a second partition dd is disposed adjacent to the first partition cc in the vertical direction so as to have a preset angle with respect to the length direction of the enclosure.

The first partition cc is not disposed in parallel with a face generated when the enclosure is cut by a plane crossing the front face portion and the rear face portion of the enclosure, but is disposed so as to have a preset angle with respect to the face, and an upper end portion of the first partition cc is disposed at a position different from that of a lower end portion of the first partition cc when viewed in a plan view. When viewed in a plan view, the upper end portion of the first partition cc is disposed to become more distant from the center to the right than the lower end portion of the first partition cc is.

In addition, the second partition dd is not disposed in parallel with the face generated when the enclosure is cut by the plane crossing the front face portion and the rear face portion of the enclosure, but is disposed so as to have a preset angle with respect to the face, and an upper end portion and a lower end portion of the second partition dd are disposed at different positions when viewed in a plan view. When viewed in a plan view, the upper end portion of the second partition dd is disposed to become closer to the center than the lower end portion of the second partition dd is.

Referring to FIG. 3B, side end portions of the first partition cc and the second partition dd are disposed to be in contact with a front face and a rear face of the enclosure, the first partition cc is a downward partition extending from the top face portion of the enclosure to the bottom face portion of the enclosure, and the second partition dd is an upward partition extending from the bottom face portion of the enclosure and provided toward the top face portion of the enclosure.

The lower end portion of the first partition cc and the upper end portion of the second partition dd are disposed to have widths that become smaller toward distal ends thereof, and are provided with triangular slots through which a sound pressure directly passes.

Traveling directions of sound pressures (sound waves) traveling in a downward direction from the second speaker unit 22 to the bottom face of the enclosure and an upward direction through a space between the first partition cc and the second partition dd and from the top face portion of the enclosure to the bottom face of the enclosure through a space between the second partition dd and a right face of the enclosure may be confirmed through FIG. 3C.

In FIG. 3C, A to O indicate virtual internal cross sections expressed at each preset interval of the enclosure, A indicates a cross section between a left end portion of the top face of the enclosure and the upper end portion of the first partition cc, and O indicates a cross section between the lower end portion of the second partition dd and a right end portion of the bottom face of the enclosure.

It may be confirmed through FIG. 3C that cross-sectional areas of a space through which the sound pressure passes gradually decrease from the speaker unit to the lower end portion of the second partition dd and are formed continuously asymmetrically in all sections.

FIG. 3D quantitatively illustrates that when it is assumed that an area of the top face portion of the enclosure is 1750, an area of part A is 1277.50, an area of part B is 1157.10, an area of part C is 1036.88, an area of part D is 916.56, and an area of part E is 796.25, such that areas gradually decrease, and the first partition cc and the second partition dd are not disposed in parallel with the face generated when the enclosure is cut by the plane crossing the front face portion and the rear face portion of the enclosure, but are disposed so as to have preset angles with respect to the face. In addition, it may be confirmed that the upper end portions and the lower end portions of the first partition cc and the second partition dd are different from each other when viewed in a plan view, and inclinations of end portions in each cross section are thus different from each other.

Figure 4A:
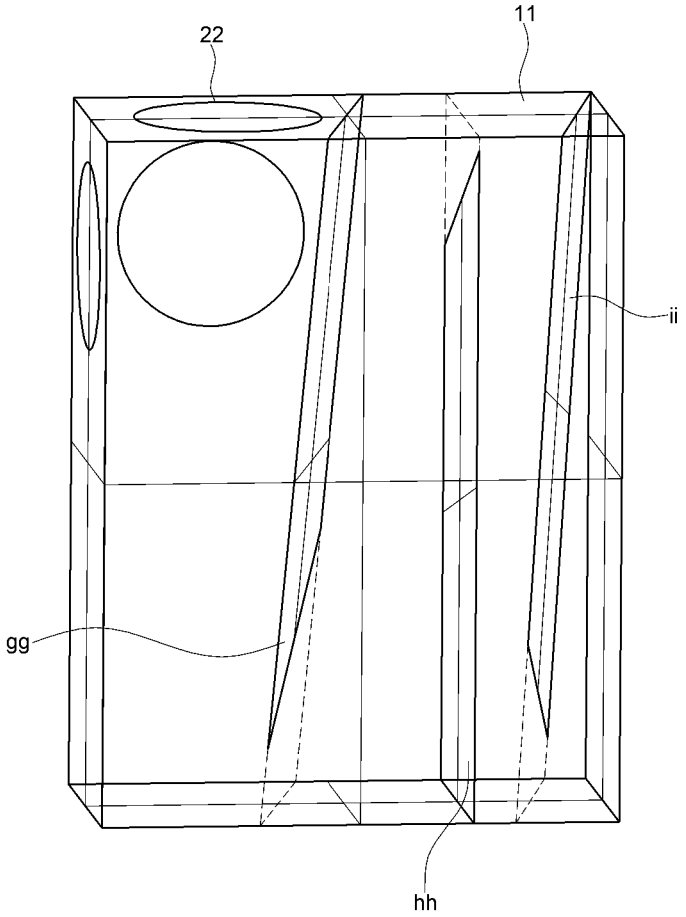
FIG. 4A is a second schematic diagram illustrating partitions partitioning spaces inside the speaker enclosure according to the present disclosure.
Figure 4B:
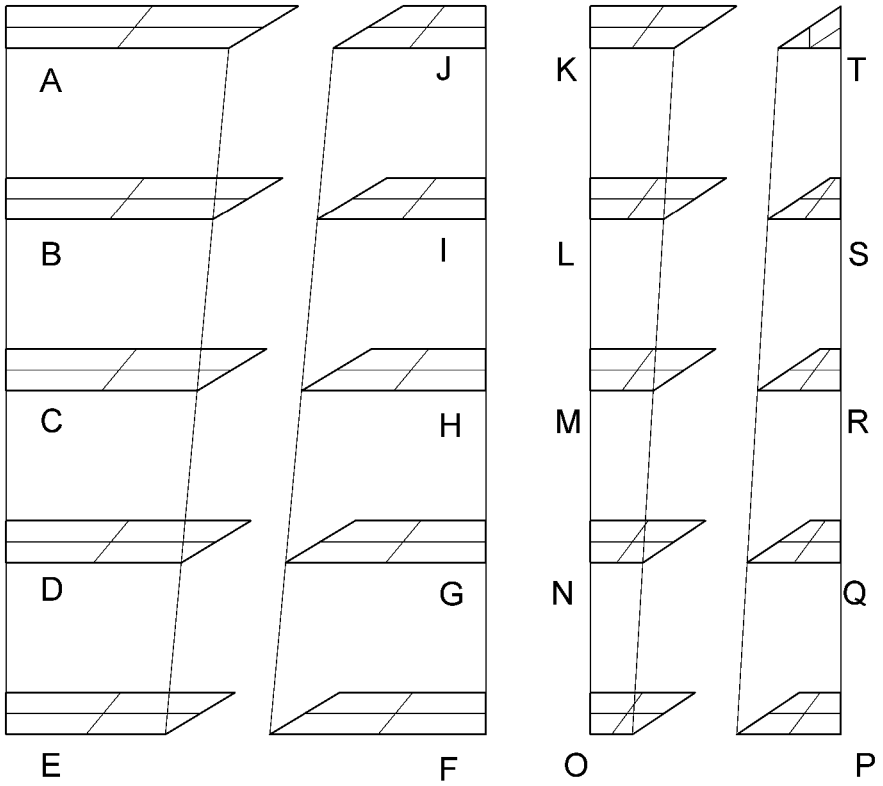
FIG. 4B is a conceptual diagram illustrating that the spaces are partitioned according to the partitions of FIG. 4A.
Figure 4C:
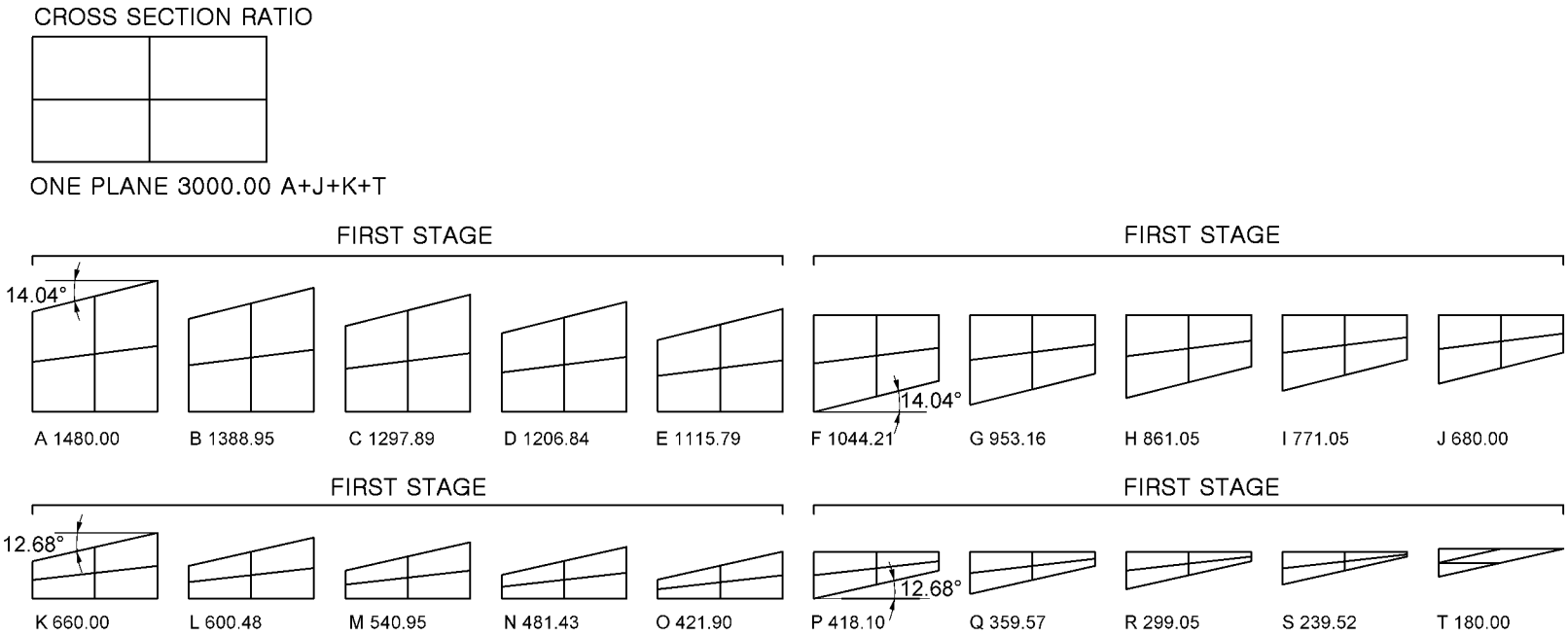
FIG. 4C is a conceptual diagram illustrating the partitioned spaces of FIG. 4B as cross-sectional areas.

FIG. 4A is a second schematic diagram illustrating partitions partitioning spaces inside the speaker enclosure according to the present disclosure, FIG. 4B is a conceptual diagram illustrating that the spaces are partitioned according to the partitions of FIG. 4A, and FIG. 4C is a conceptual diagram illustrating the partitioned spaces of FIG. 4B as cross-sectional areas.

In FIGS. 4A to 4C, one partition is further added to the speaker enclosure (FIGS. 3A to 3D) according to an embodiment of the present disclosure. One partition is further added, such that one moving path of a sound pressure (sound wave) is further added.

An upper end portion of a third partition gg is disposed on a relatively right side and a lower end portion of the third partition gg is disposed on a relatively left side in order to reduce cross sections along a traveling direction of the sound pressure, a fourth partition hh may be disposed vertically, and a lower end portion of a fifth partition ii is disposed on a relatively left side and an upper end portion of the fifth partition ii is disposed on a relatively right side in order to reduce cross sections along a traveling direction of the sound pressure.

The lower end portions of the third partition gg and the fifth partition ii may be disposed to be in contact with the bottom face portion of the enclosure, but may be spaced apart from the bottom face portion of the enclosure by a preset interval, and an upper end portion of the fourth partition hh may also be disposed to be in contact with the top face portion of the enclosure, but may be spaced apart from the top face portion of the enclosure by a preset interval.

Referring to FIGS. 4B and 4C, it may be confirmed that cross-sectional areas of a space through which the sound pressure (sound wave) passes gradually decrease from the speaker unit to the upper end portion of the fifth partition ii and are formed asymmetrically.

FIGS. 5A to 15B illustrate various dispositions of partitions inside enclosures according to embodiments of the present disclosure.

Figure 5A:
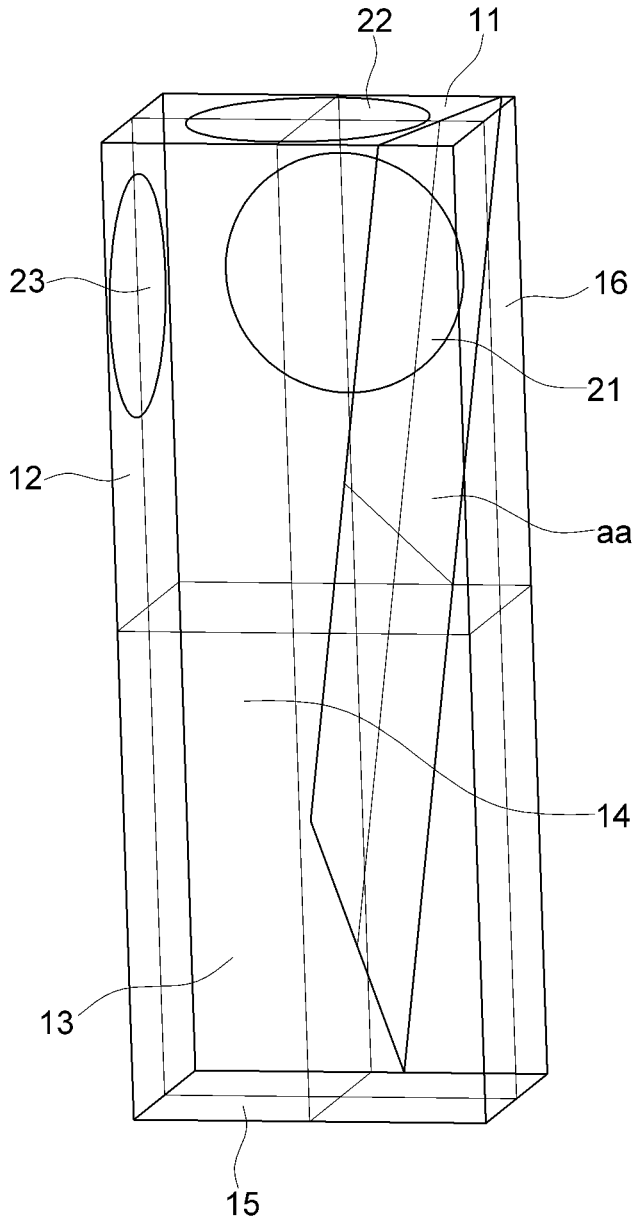
FIG. 5A is a schematic diagram illustrating an enclosure according to a first embodiment of the present disclosure.
Figure 5B:
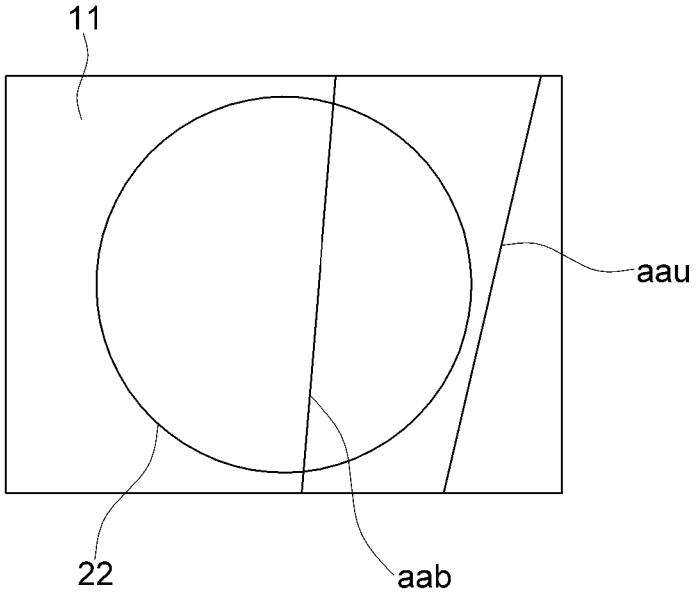
FIG. 5B is a plan view illustrating the enclosure of FIG. 5A.

FIG. 5A is a schematic diagram illustrating an enclosure according to a first embodiment of the present disclosure, and FIG. 5B is a plan view illustrating the enclosure of FIG. 5A.

Referring to FIG. 5A, the enclosure according to the first embodiment of the present disclosure includes one partition aa, and one or more speaker units may be disposed on a top face portion of the enclosure according to a disposition of the partition aa. In the present embodiment, three speaker units are disposed.

First to third speaker units 21, 22, and 23 may be disposed on a front face portion, a top face portion, and a left face portion of the enclosure, respectively, the first speaker unit 21 may be disposed adjacent to the top face portion of the enclosure so as to be disposed in a left space partitioned by the partition aa, and the second speaker unit 22 may be disposed at the center of the top face portion of the enclosure or be disposed to be biased toward the left of the top face portion of the enclosure so as to be disposed in the left space partitioned by the partition aa.

The partition aa is not disposed in parallel with a face (cross section) generated when the enclosure is cut by a plane crossing a front face portion and a rear face portion of the enclosure, but is disposed to have a preset angle with respect to the face.

Referring to FIG. 5B, an upper end portion aau and a lower end portion aab of the partition aa are disposed at different positions when viewed in a plan view. That is, when viewed in a plan view, the lower end portion aab of the partition aa is disposed to become closer to the center of a top face portion 11 of the enclosure than the upper end portion aau of the partition aa is.

In addition, when viewed in a plan view from the top of the enclosure, a length and a rotation angle of the upper end portion aau of the partition aa are different from a length and a rotation angle of the lower end portion aab of the partition aa.

The upper end portion aau and a side portion of the partition aa are disposed to be in contact with an inner face of the enclosure, and the lower end portion aab of the partition aa is disposed to have a width that becomes smaller toward a distal end thereof. Therefore, a triangular slot allowing the left and the right of the partition aa to be in communication with each other is formed at the lower end portion aab of the partition aa.

A two-stage passage through which a sound wave travels is provided inside the enclosure according to a disposition of the partition inside the enclosure according to the first embodiment of the present disclosure. A first passage provided by the left face of the enclosure, parts of the front face portion and the rear face portion of the enclosure, and the partition aa is formed from the top face portion of the enclosure to the bottom face portion of the enclosure, and a second passage provided by the right face of the enclosure, parts of the front face portion and the rear face portion of the enclosure, and the partition aa is formed from the bottom face portion of the enclosure to the top face portion of the enclosure.

Both of the first passage and the second passage have cross-sectional areas that become smaller toward the direction in which the sound wave travels, and are formed asymmetrically.

Figure 6A:
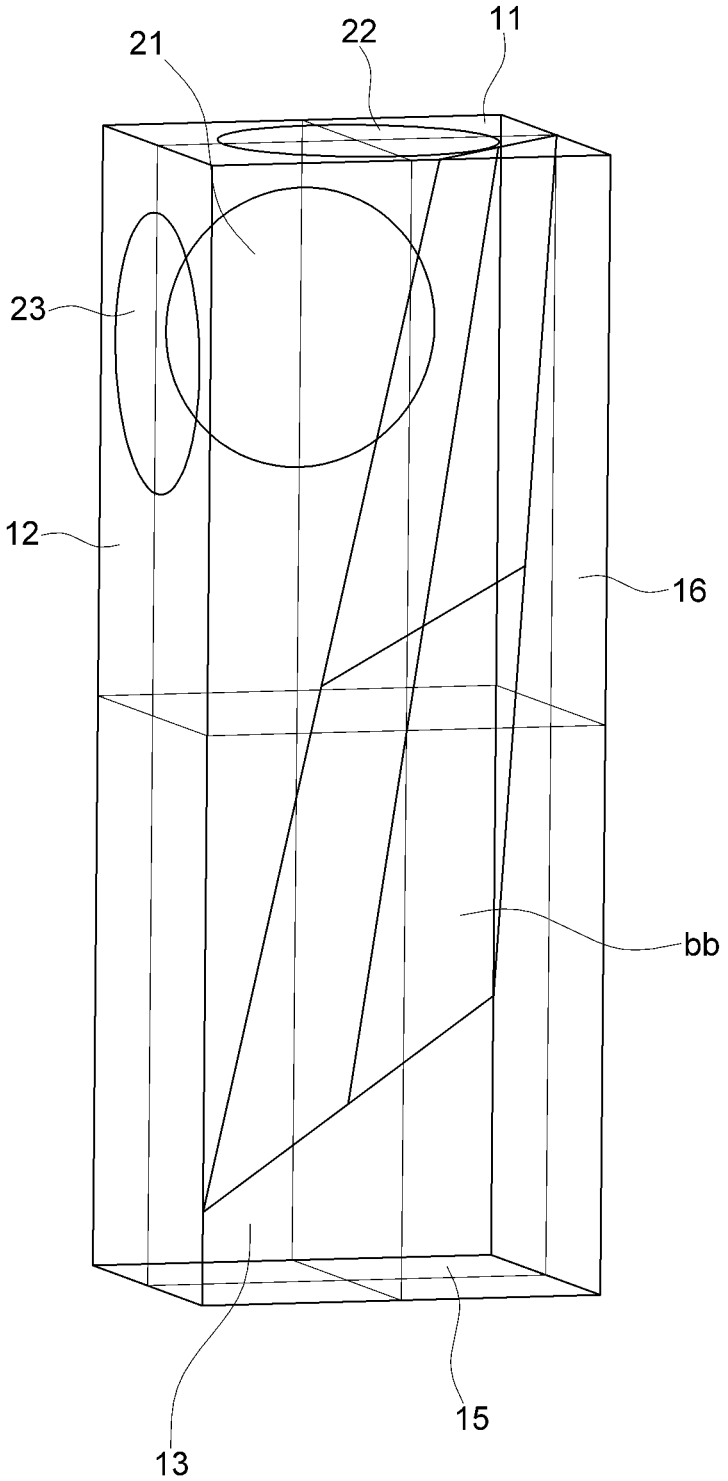
FIG. 6A is a schematic diagram illustrating an enclosure according to a second embodiment of the present disclosure.
Figure 6B:
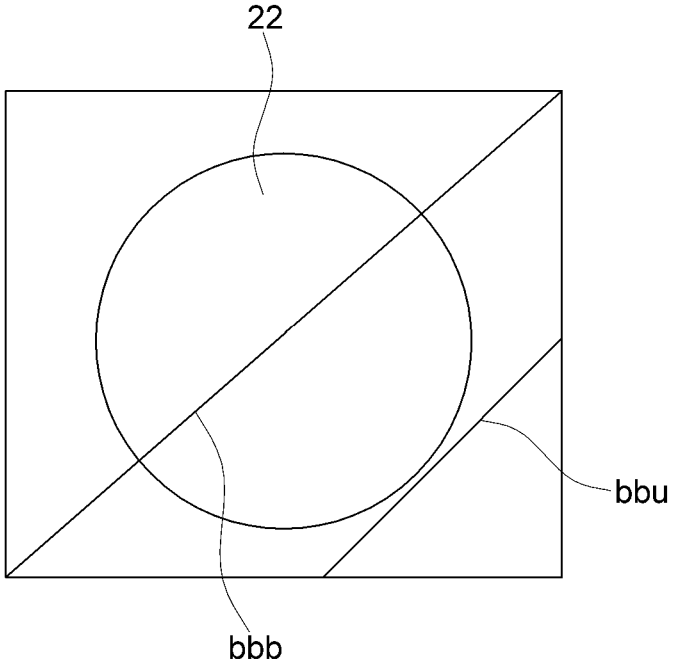
FIG. 6B is a plan view illustrating the enclosure of FIG. 6A.

FIG. 6A is a schematic diagram illustrating an enclosure according to a second embodiment of the present disclosure, and FIG. 6B is a plan view illustrating the enclosure of FIG. 6A.

The enclosure according to the second embodiment of the present disclosure has a configuration corresponding to that of the enclosure according to the first embodiment of the present disclosure, and configurations different from those of the enclosure according to the first embodiment of the present disclosure will be mainly described.

The enclosure according to the second embodiment of the present disclosure is provided with one partition bb. The partition bb is not disposed in parallel with a face (cross section) generated when the enclosure is cut by a plane crossing a front face portion and a rear face portion of the enclosure, but is disposed to have a preset angle with respect to the face.

Referring to FIG. 6B, an upper end portion bbu and a lower end portion bbb of the partition bb are disposed at different positions when viewed in a plan view. That is, when viewed in a plan view, the lower end portion bbb of the partition bb is disposed in a diagonal direction of a top face portion 11 of the enclosure, and the upper end portion bbu of the partition bb is disposed to be biased toward a corner of the top face portion 11.

The lower end portion bbb of the partition bb is disposed so as not to be in contact with a bottom face portion of the enclosure, but may also be disposed so that a part of the lower end portion bbb of the partition bb is in contact with the bottom face portion.

A two-stage passage through which a sound wave travels is provided inside the enclosure according to a disposition of the partition inside the enclosure according to the second embodiment of the present disclosure. The passage through which a sound wave travels includes a first passage provided by the left of the partition bb and a second passage provided by the right of the partition bb.

Both of the first passage and the second passage have cross-sectional areas that become smaller toward the direction in which the sound wave travels, and are formed asymmetrically.

Figure 7A:
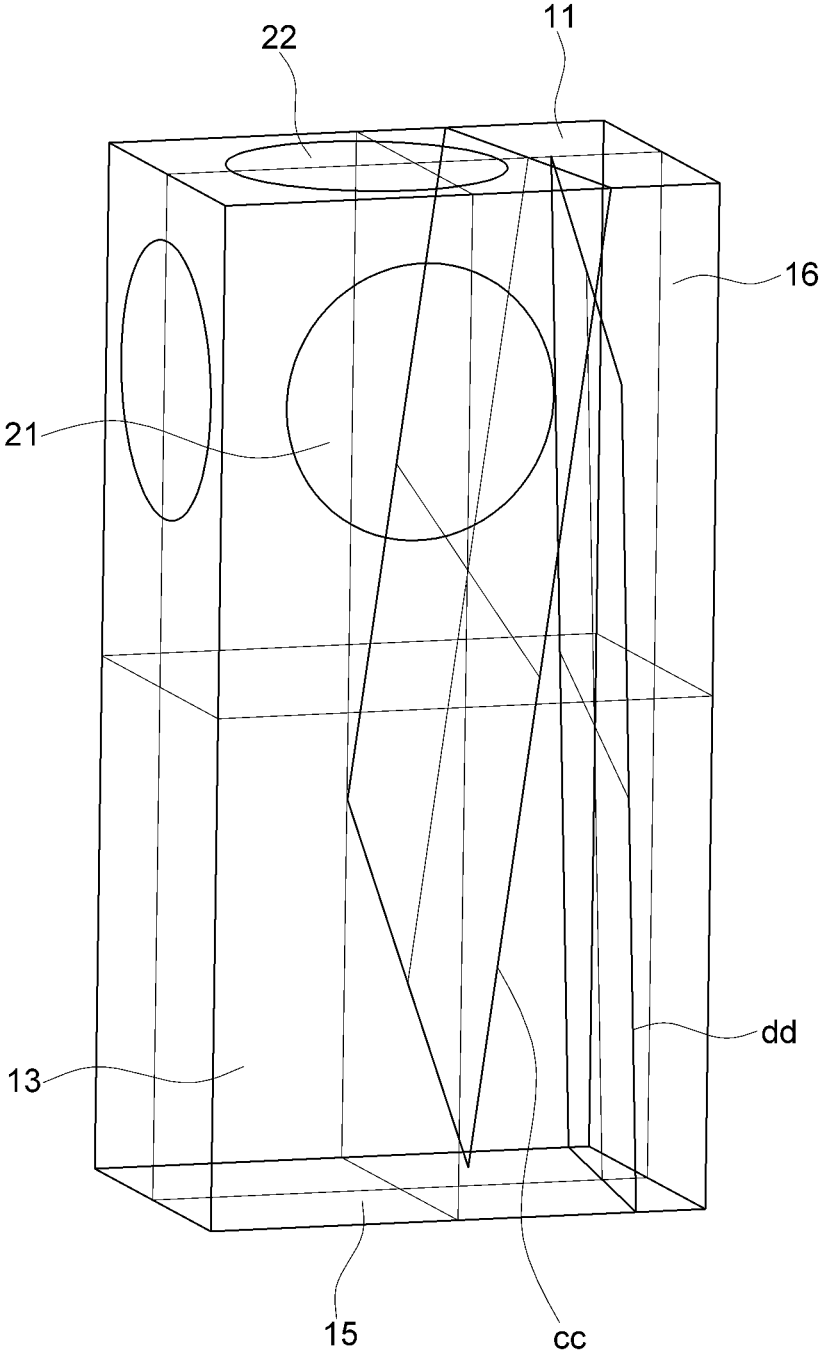
FIG. 7A is a schematic diagram illustrating an enclosure according to a third embodiment of the present disclosure.
Figure 7B:
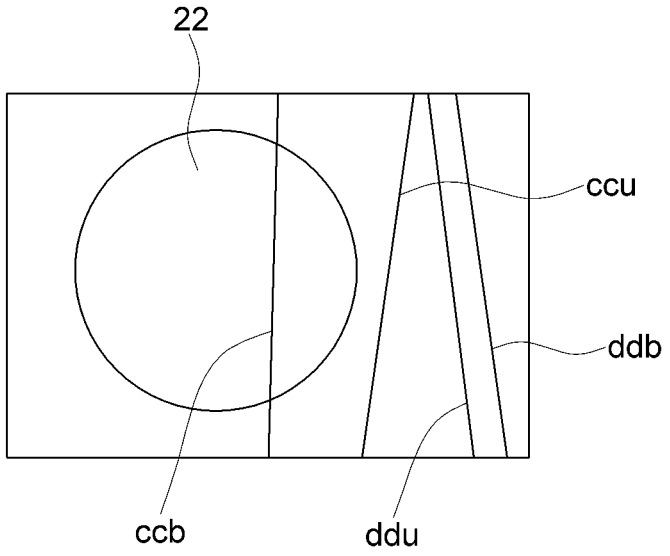
FIG. 7B is a plan view illustrating the enclosure of FIG. 7A.

FIG. 7A is a schematic diagram illustrating an enclosure according to a third embodiment of the present disclosure, and FIG. 7B is a plan view illustrating the enclosure of FIG. 7A.

Referring to FIG. 7A, the enclosure according to the third embodiment of the present disclosure includes two partitions cc and dd, and one or more speaker units may be disposed on a top face portion of the enclosure according to dispositions of the partitions cc and dd. In the present embodiment, three speaker units are disposed.

The partitions cc and dd are not disposed in parallel with a face (cross section) generated when the enclosure is cut by a plane crossing a front face portion and a rear face portion of the enclosure, but are disposed to have a preset angle with respect to the face.

Referring to FIG. 7B, an upper end portion ccu and a lower end portion ccb of the partition cc are disposed at different positions when viewed in a plan view. That is, when viewed in a plan view, the lower end portion ccb of the partition cc is disposed more adjacent to the center of a top face portion 11 of the enclosure than the upper end portion ccu of the partition cc is. In addition, when viewed in a plan view, an upper end portion ddu and a lower end portion ddb of the partition dd are disposed at different positions. That is, when viewed in a plan view, the lower end portion ddb of the partition dd is disposed more adjacent to a right face of the enclosure than the upper end portion ddu of the partition dd is.

In addition, when viewed in a plan view from the top of the enclosure, a length and a rotation angle of the upper end portion ccu of the partition cc are different from a length and a rotation angle of the lower end portion ccb of the partition cc, and a length and a rotation angle of the upper end portion ddu of the partition dd are different from a length and a rotation angle of the lower end portion ddb of the partition dd.

The partition cc is a downward partition extending from a top face portion of the enclosure to a bottom face portion of the enclosure, and the partition dd is an upward partition extending from the bottom face portion of the enclosure and provided toward the top face portion of the enclosure. The downward partition and the upward partition are alternately disposed.

A three-stage passage through which a sound wave travels is provided inside the enclosure according to a disposition of the partition inside the enclosure according to the third embodiment of the present disclosure. A first passage provided by a left face of the enclosure, parts of a front face portion and a rear face portion of the enclosure, and the partition cc is formed from the top face portion of the enclosure to the bottom face portion of the enclosure, a second passage provided by the partition dd, parts of the front face portion and the rear face portion of the enclosure, and the partition cc is formed from the bottom face portion of the enclosure to the top face portion of the enclosure, and a third passage provided by a right face of the enclosure, parts of the front face portion and the rear face portion of the enclosure, and the partition dd is formed from the top face portion of the enclosure to the bottom face portion of the enclosure.

All of the first to third passages have cross-sectional areas that become smaller toward the direction in which the sound wave travels, and are formed asymmetrically.

Figure 8A:
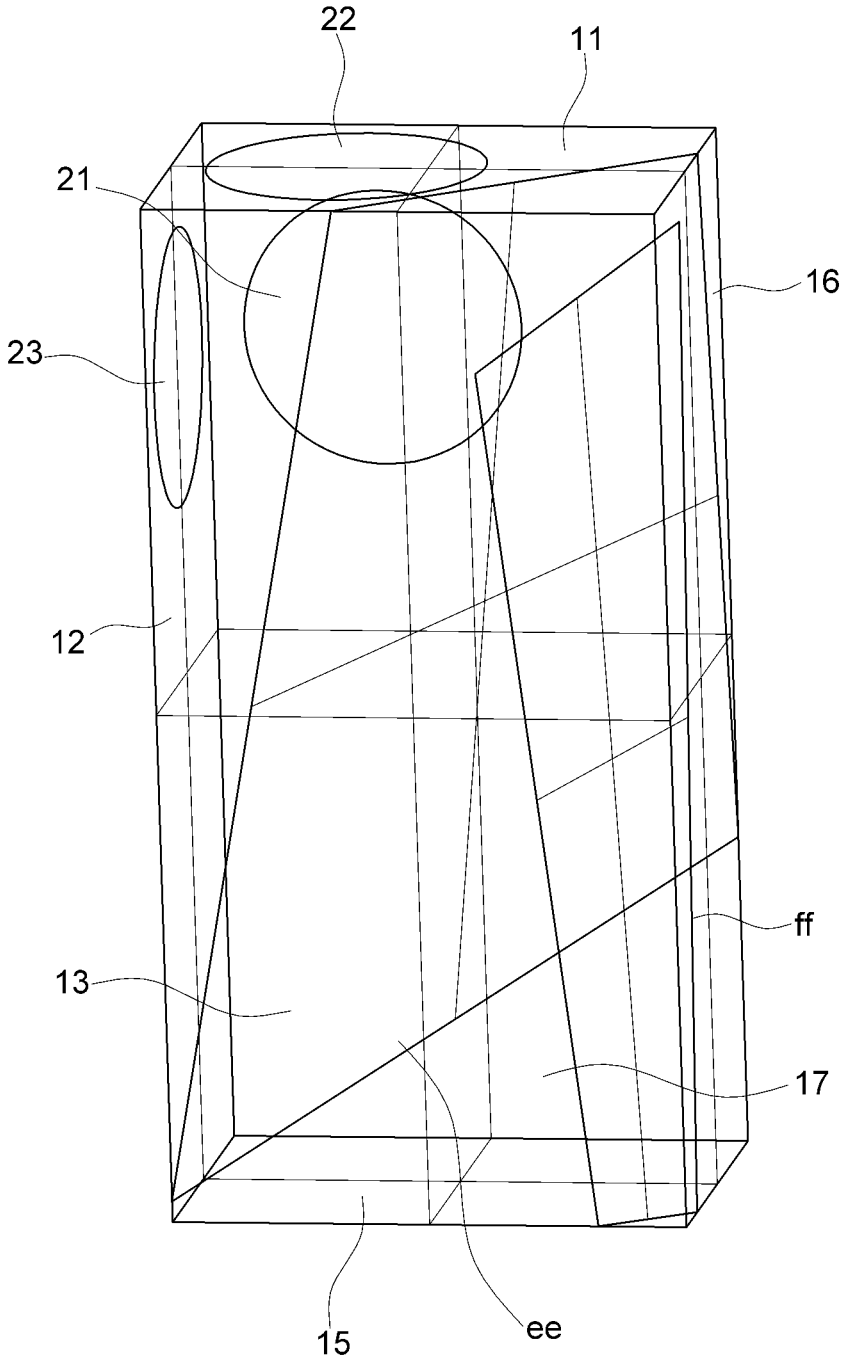
FIG. 8A is a schematic diagram illustrating an enclosure according to a fourth embodiment of the present disclosure.
Figure 8B:
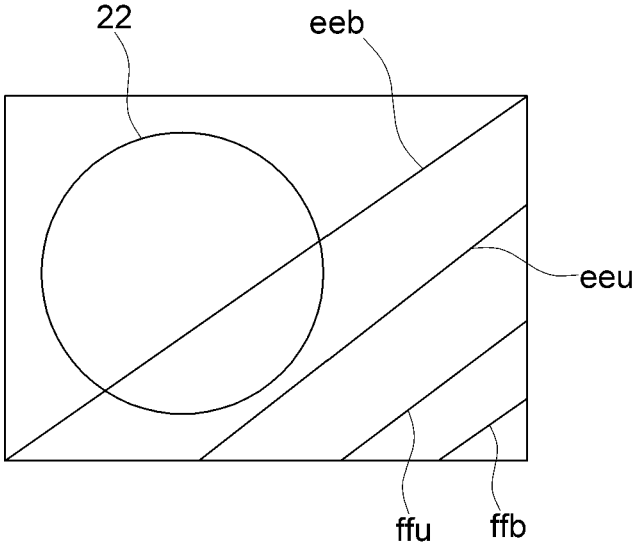
FIG. 8B is a plan view illustrating the enclosure of FIG. 8A.

FIG. 8A is a schematic diagram illustrating an enclosure according to a fourth embodiment of the present disclosure, and FIG. 8B is a plan view illustrating the enclosure of FIG. 8A.

The enclosure according to the fourth embodiment of the present disclosure has a configuration corresponding to that of the enclosure according to the third embodiment of the present disclosure, and configurations different from those of the enclosure according to the third embodiment of the present disclosure will be mainly described.

The enclosure according to the fourth embodiment of the present disclosure is provided with two partitions ee and ff. The partitions ee and ff are not disposed in parallel with a face (cross section) generated when the enclosure is cut by a plane crossing a front face portion and a rear face portion of the enclosure, but are disposed to have a preset angle with respect to the face.

Referring to FIG. 8B, an upper end portion eeu and a lower end portion eeb of the partition ee are disposed at different positions when viewed in a plan view. That is, when viewed in a plan view, the lower end portion eeb of the partition ee is disposed in a diagonal direction of a top face portion 11 of the enclosure, and the upper end portion eeu of the partition ee is disposed to be biased toward a corner of the top face portion 11.

The partition ff, which is an upward partition, is disposed to extend from a bottom face portion 15 of the enclosure to a portion adjacent to the top face portion 11 of the enclosure, and the partition ff is disposed to be in contact with a rear face portion and a right face portion of the enclosure and be biased toward a portion where the rear face portion and the right face portion are in contact with each other, toward a lower end portion ffb thereof.

Figure 9A:
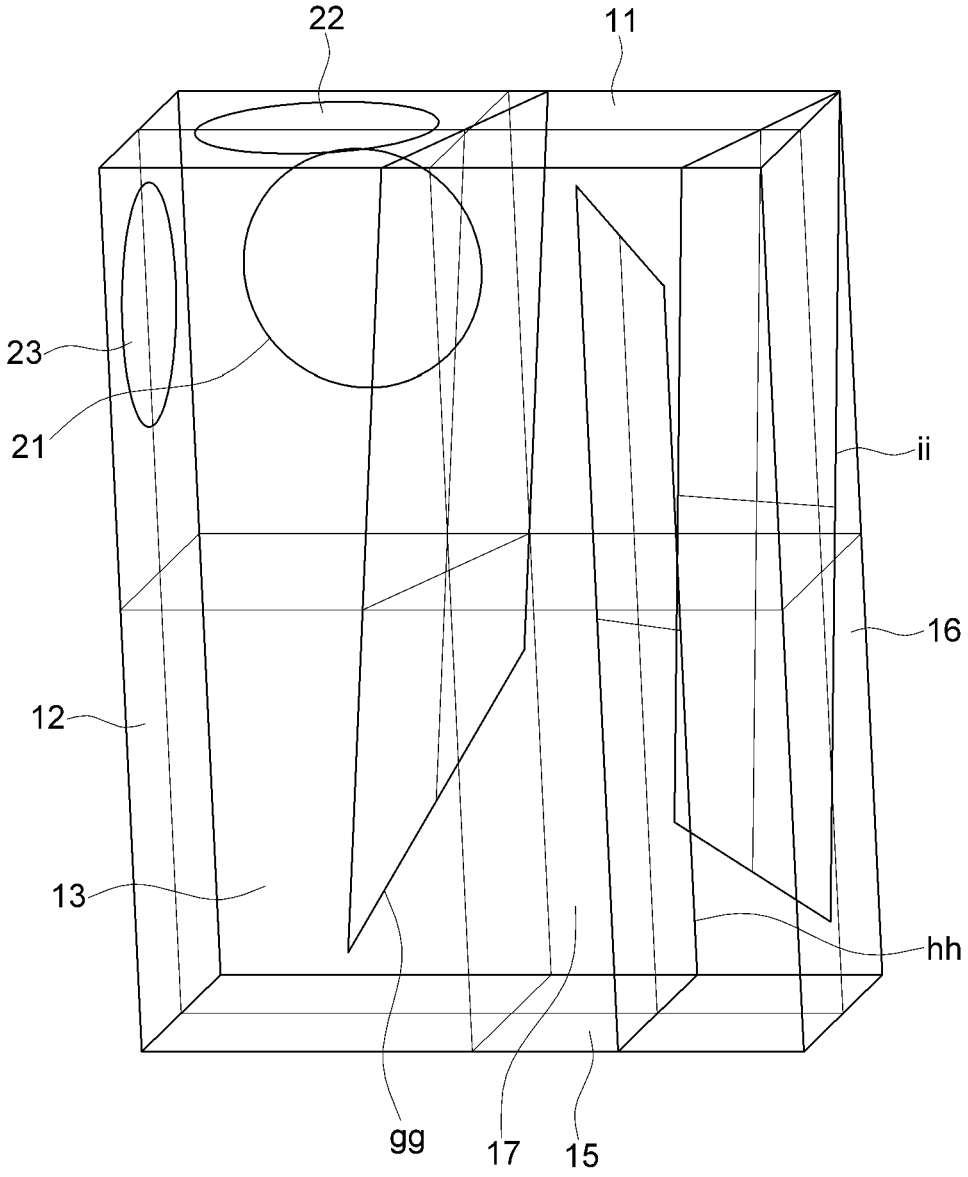
FIG. 9A is a schematic diagram illustrating an enclosure according to a fifth embodiment of the present disclosure.
Figure 9B:
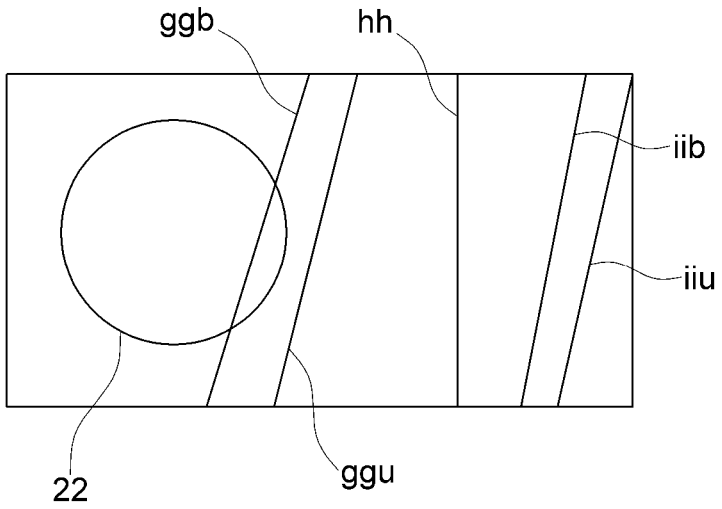
FIG. 9B is a plan view illustrating the enclosure of FIG. 9A.

FIG. 9A is a schematic diagram illustrating an enclosure according to a fifth embodiment of the present disclosure, and FIG. 9B is a plan view illustrating the enclosure of FIG. 9A.

The enclosure according to the fifth embodiment of the present disclosure is partitioned by three partitions by further including one partition added to the enclosure according to the third embodiment of the present disclosure, and a downward partition, an upward partition, and a downward partition are alternately disposed.

The enclosure according to the fifth embodiment of the present disclosure is an enclosure corresponding to that of FIGS. 4A to 4C described above, and a four-stage passage through which a sound wave travels according to dispositions of partitions is provided inside the enclosure. That is, four tunnel-type passages are provided among a left face portion 12, a partition gg, a partition hh, a partition ii, and a right face portion 16.

Both of a first passage and a fourth passage have cross-sectional areas that become smaller toward the direction in which the sound wave travels, and are formed asymmetrically.

Speaker units 21, 22, and 23 are disposed at an upper portion of the first passage. Referring to FIG. 9B, the partition hh provided between the partition gg and the partition ii of which lengths and rotation angles of upper end portions are different from lengths and rotation angles of lower end portions may be disposed so that rotation angles of an upper end portion and a lower end portion thereof are the same as each other (it does not rotate with respect to an axis of the enclosure in a length direction). However, the partition hh is not limited thereto, and may be disposed to rotate by a preset rotation angle in order to form an asymmetric cross section.

Figure 10A:
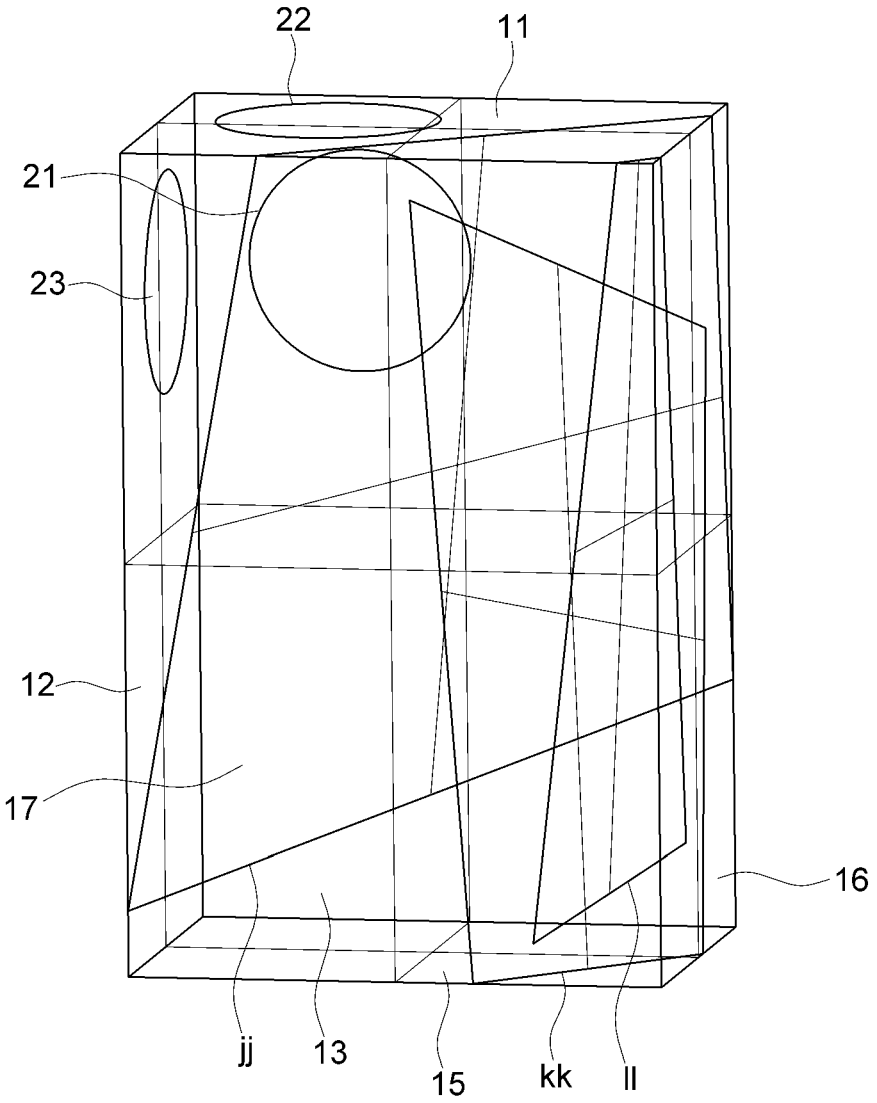
FIGS. 10A and 10B are schematic diagrams illustrating an enclosure according to a sixth embodiment of the present disclosure.
Figure 10B:
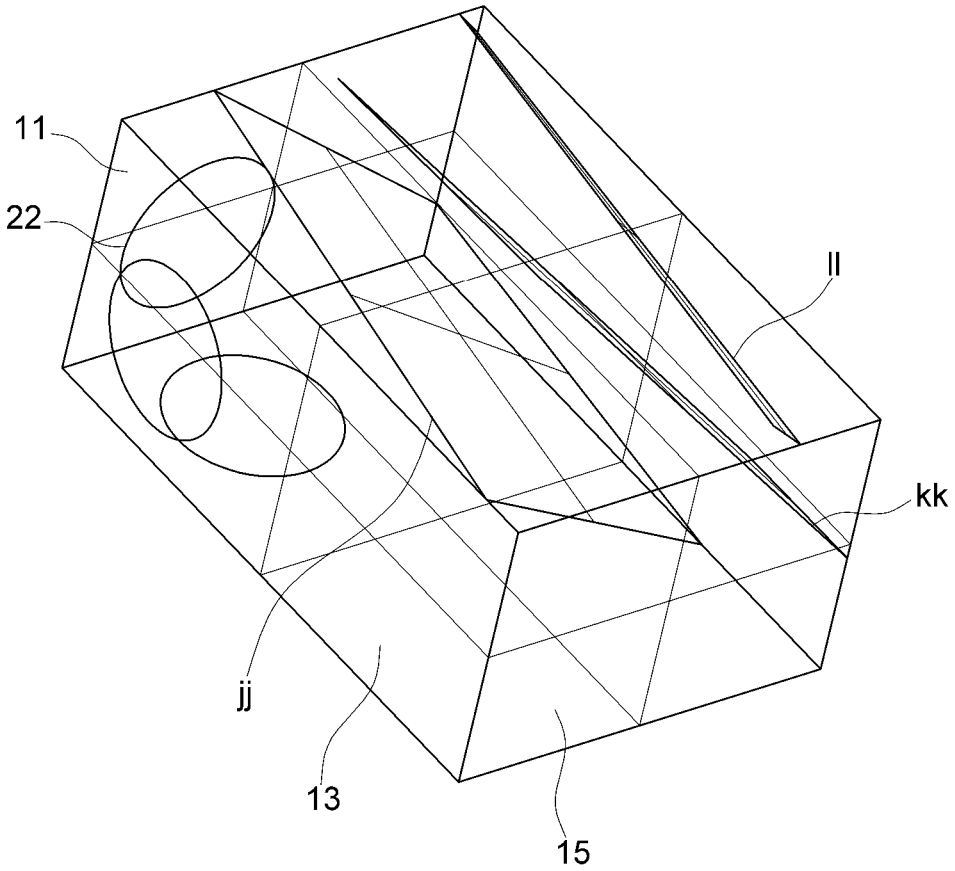
Figure 10C:
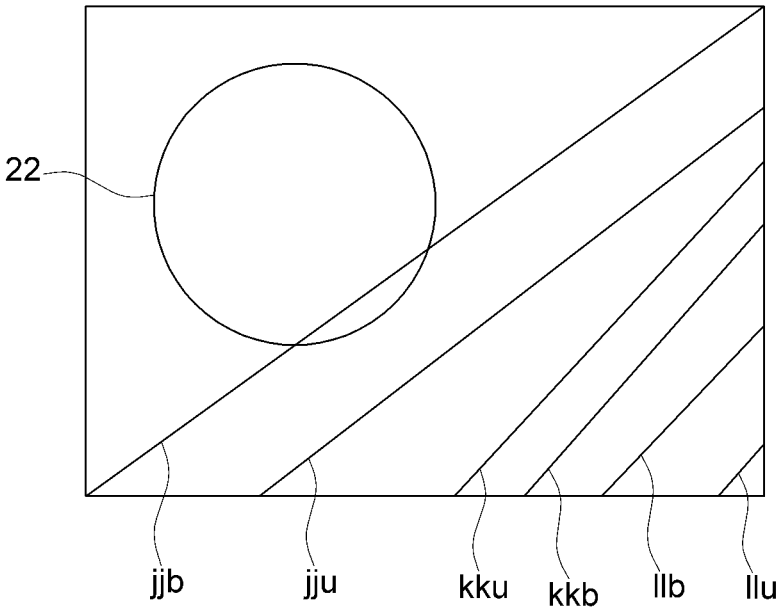
FIG. 10C is a plan view illustrating the enclosure of FIGS. 10A and 10B.

FIGS. 10A and 10B are schematic diagrams illustrating an enclosure according to a sixth embodiment of the present disclosure, and FIG. 10C is a plan view illustrating the enclosure of FIGS. 10A and 10B.

The enclosure according to the sixth embodiment of the present disclosure corresponds to the enclosure according to the fifth embodiment of the present disclosure in most of the configurations in that it has four passages, and is different from the enclosure according to the fifth embodiment of the present disclosure in that the other end portion of one jj of partitions jj, kk, and ll is disposed diagonally.

Both of a first passage and a fourth passage provided in the enclosure according to the sixth embodiment of the present disclosure have cross-sectional areas that become smaller toward the direction in which the sound wave travels, and are formed asymmetrically.

Figure 11A:
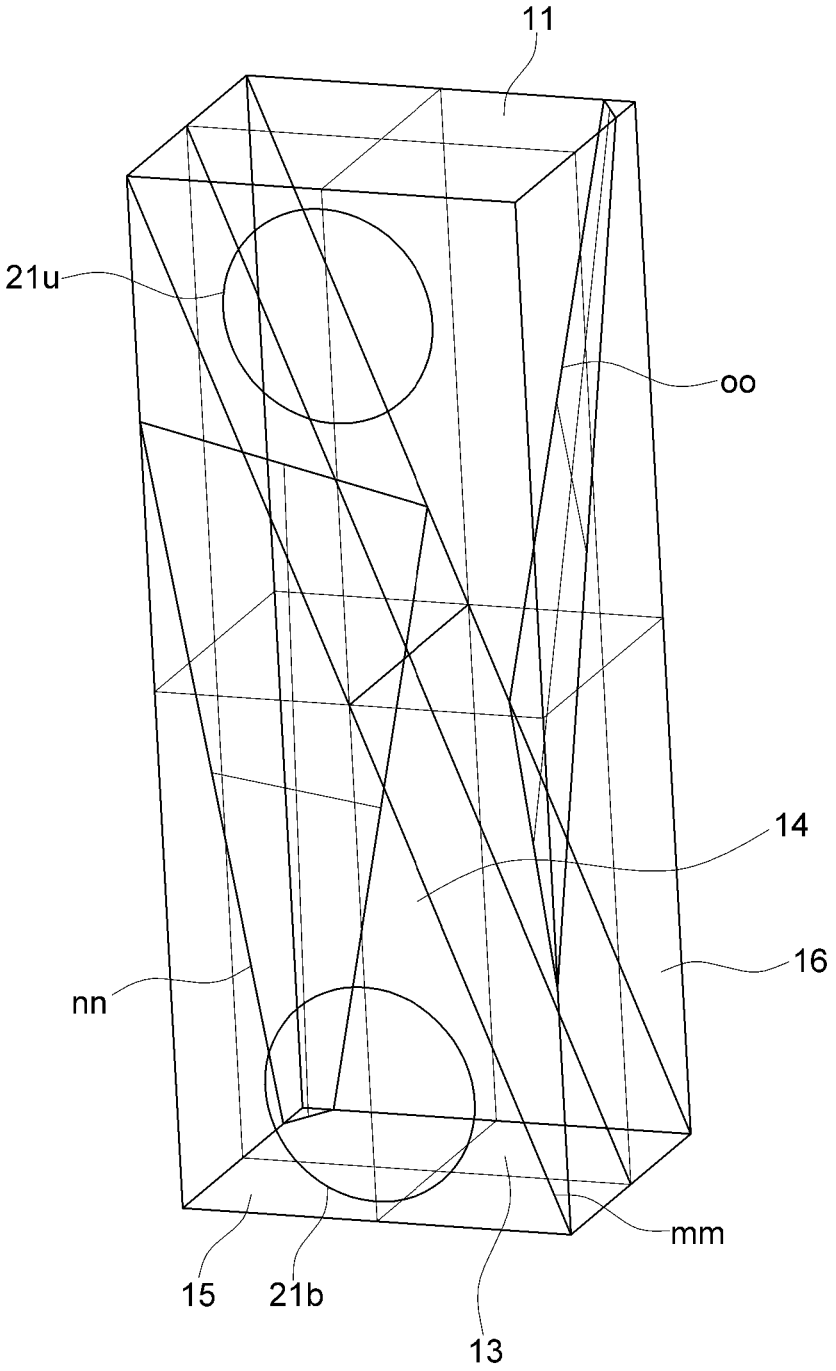
FIGS. 11A and 11B are schematic diagrams illustrating an enclosure according to a seventh embodiment of the present disclosure.
Figure 11B:
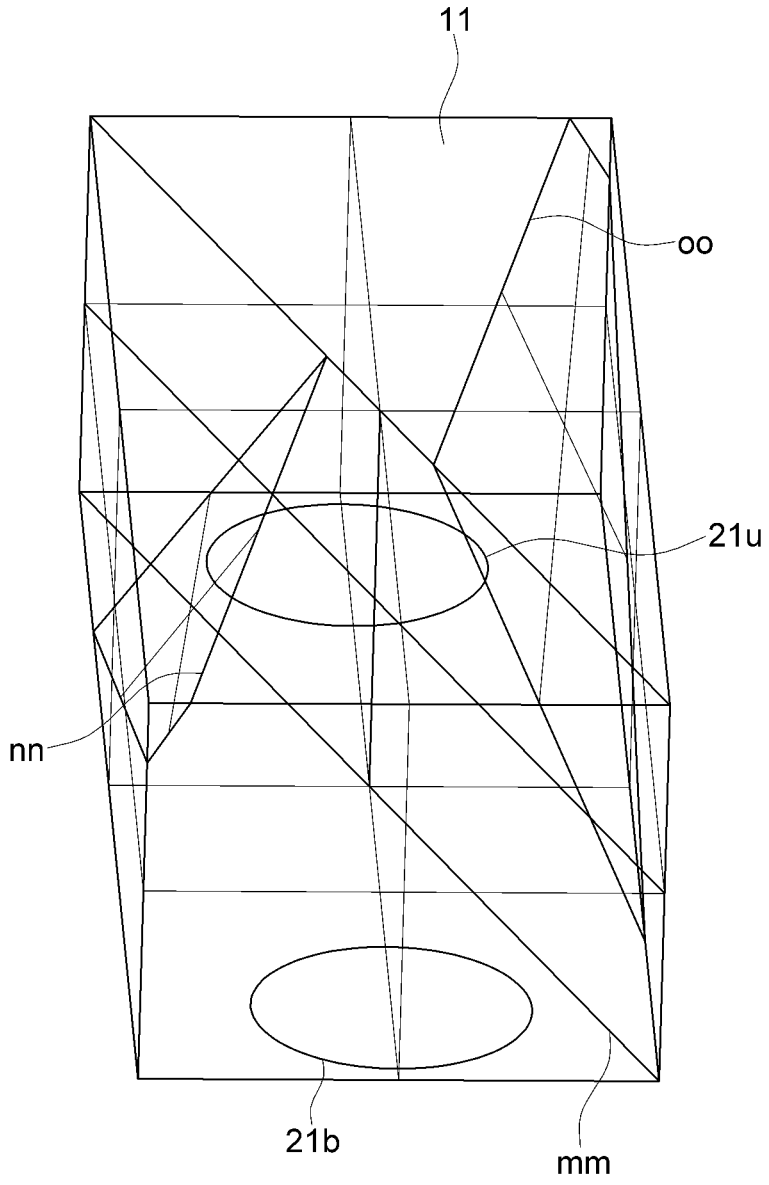
Figure 11C:
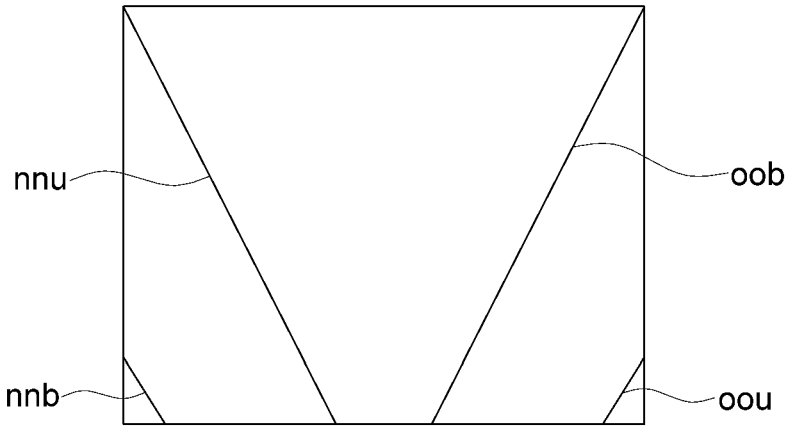
FIG. 11C is a plan view illustrating the enclosure of FIGS. 11A and 11B.

FIGS. 11A and 11B are schematic diagrams illustrating an enclosure according to a seventh embodiment of the present disclosure, and FIG. 11C is a plan view illustrating the enclosure of FIGS. 11A and 11B.

A partition according to the seventh embodiment of the present disclosure is provided as a partition mm connecting one side of a top face portion 11 of the enclosure and the other side of a bottom face portion 15 of the enclosure to each other.

One or more speaker units may be provided on one side and the other side of the partition mm. Two moving passages of a sound wave may be provided on the basis of a speaker unit 21*b* positioned on one side of the partition mm, and two moving passages of a sound wave may be provided on the basis of a speaker unit 21*u* positioned on the other side of the partition mm.

A partition mm may be provided as an upward partition on one side of the partition mm, and a partition oo may be provided as a downward partition on the other side of the partition mm.

Each moving passage has a cross-sectional area that gradually decreases in a traveling direction of the sound wave, and is provided asymmetrically.

Figure 12A:
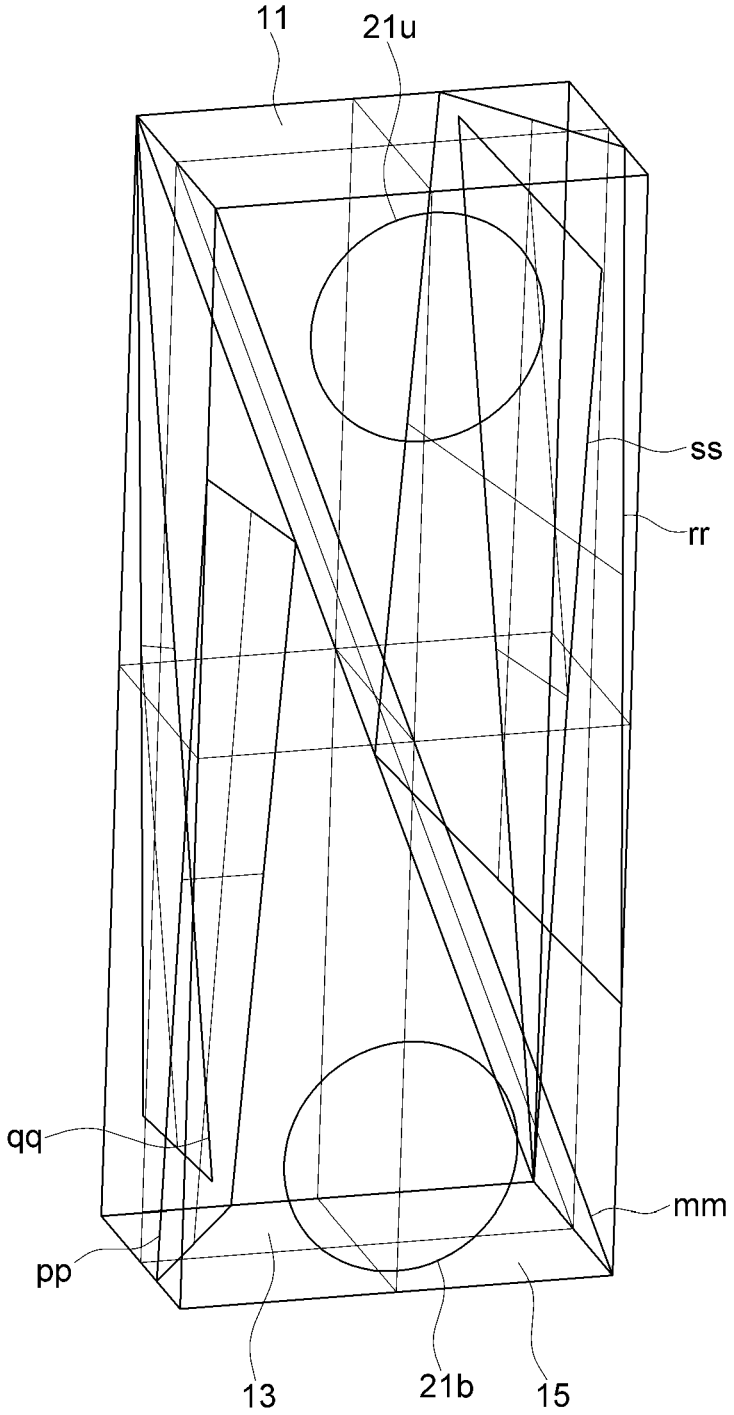
FIGS. 12A and 12B are schematic diagrams illustrating an enclosure according to an eighth embodiment of the present disclosure.
Figure 12B:
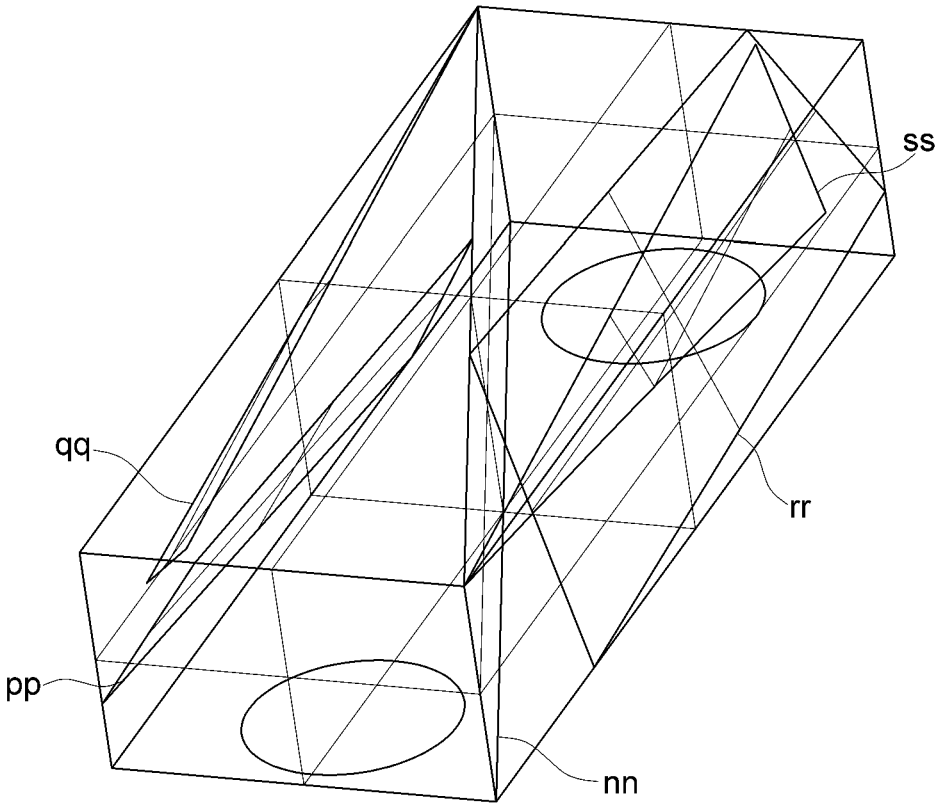
Figure 12C:
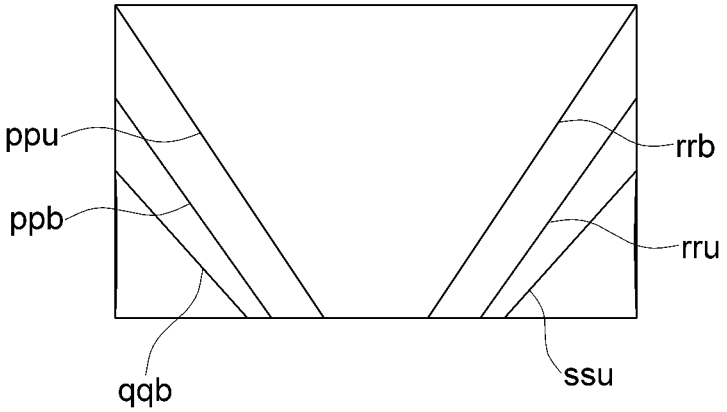
FIG. 12C is a plan view illustrating the enclosure of FIGS. 12A and 12B.

FIGS. 12A and 12B are schematic diagrams illustrating an enclosure according to an eighth embodiment of the present disclosure, and FIG. 12C is a plan view illustrating the enclosure of FIGS. 12A and 12B.

The enclosure according to the eighth embodiment of the present disclosure corresponds to the enclosure according to the seventh embodiment of the present disclosure in most of the configurations, and one partition is further added to one side and the other side of a partition mm, such that three moving passages of a sound wave are provided on each of one side and the other side of the partition mm. Each moving passage has a cross-sectional area that gradually decreases in a traveling direction of the sound wave, and is provided asymmetrically.

End portions of some qq and ss of partitions may be disposed to be in contact with corners.

Figure 13:
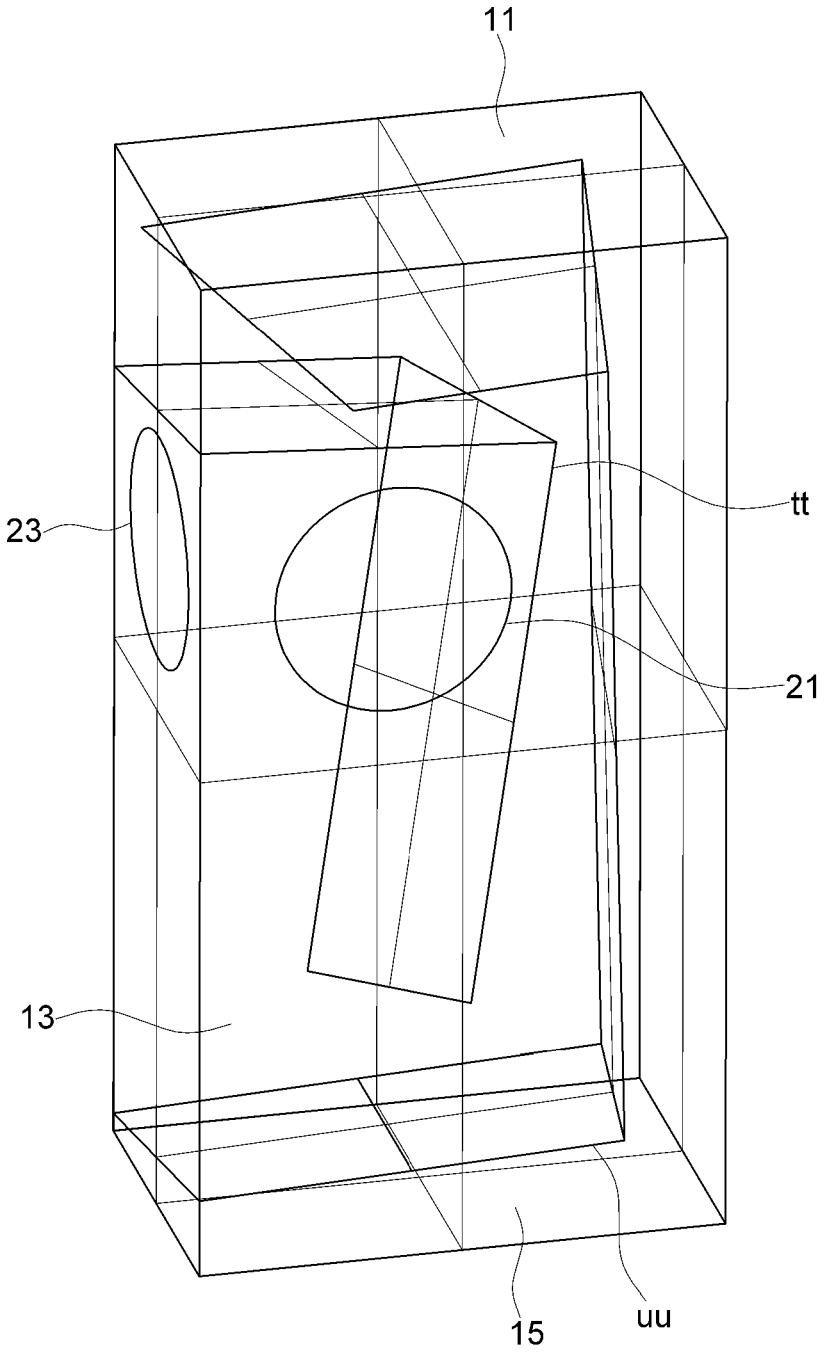
FIG. 13 is a schematic diagram illustrating an enclosure according to a ninth embodiment of the present disclosure.
Figure 14:
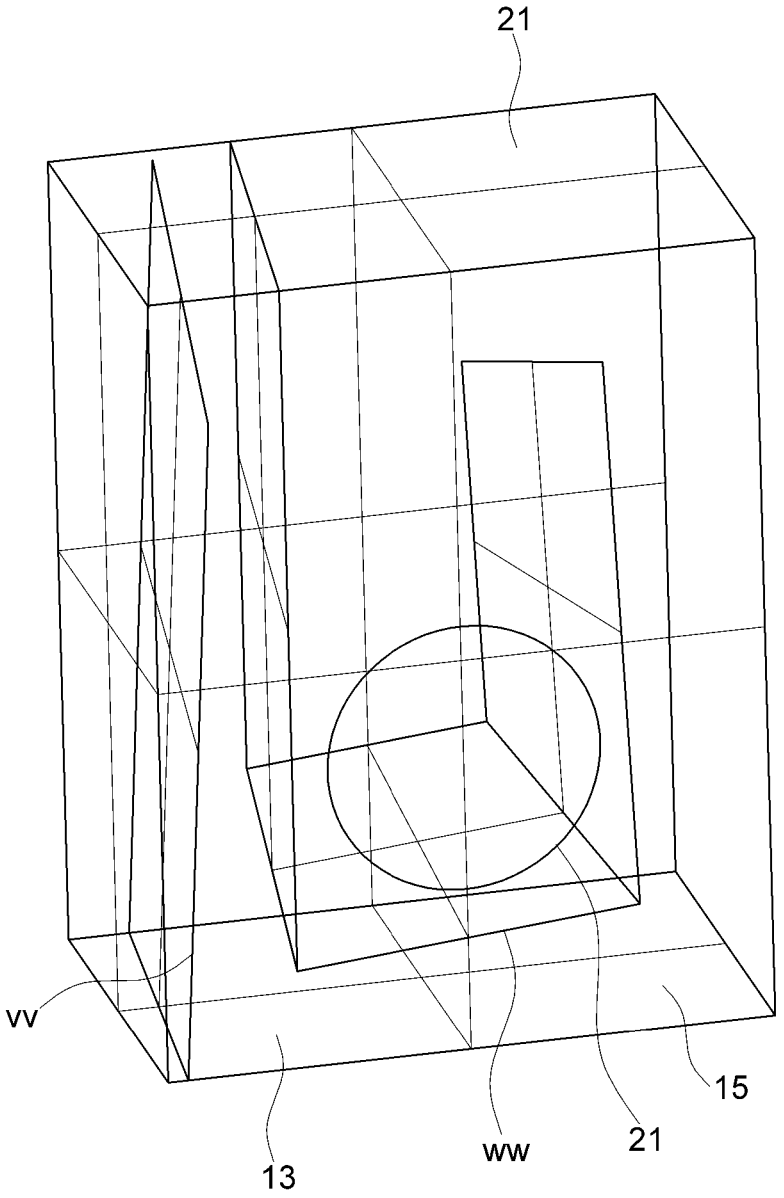
FIG. 14 is a schematic diagram illustrating an enclosure according to a tenth embodiment of the present disclosure.
Figure 15A:
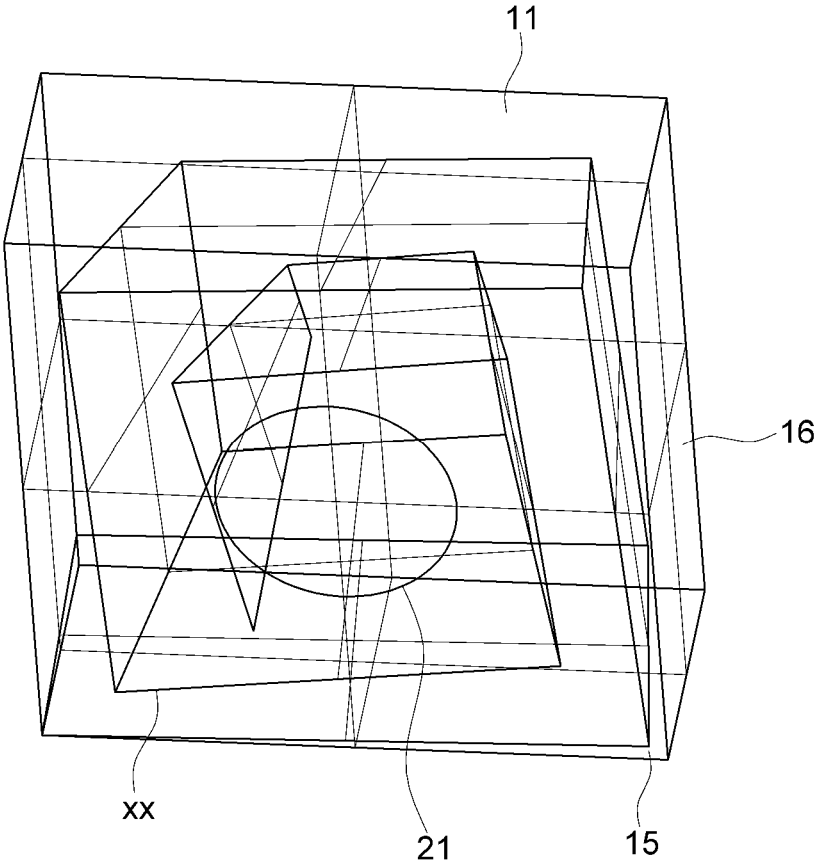
FIGS. 15A and 15B are schematic diagrams illustrating an enclosure according to an eleventh embodiment of the present disclosure.
Figure 15B:
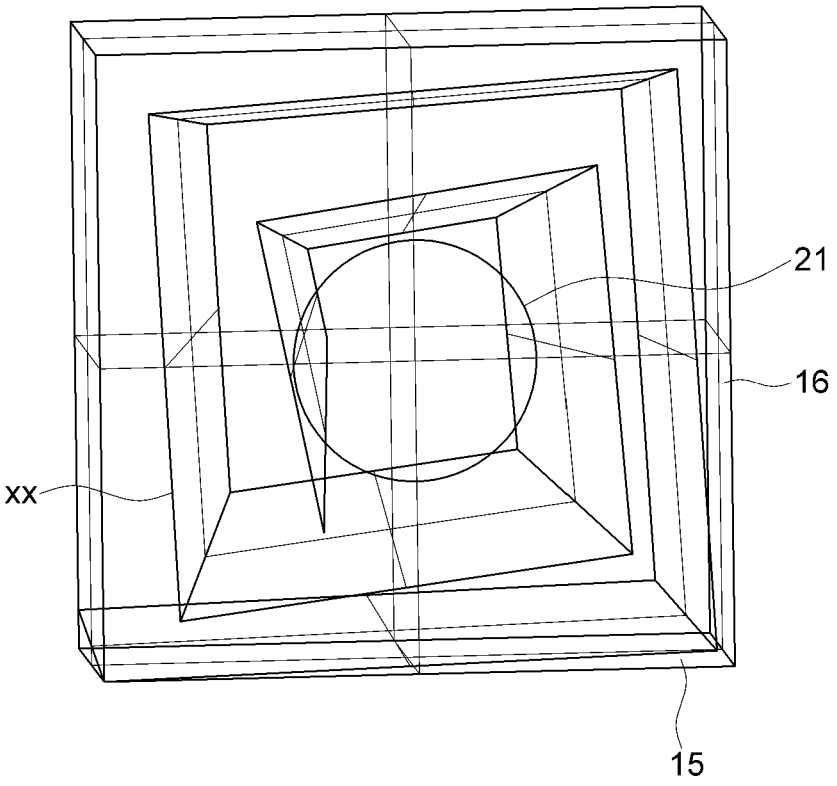

FIG. 13 is a schematic diagram illustrating an enclosure according to a ninth embodiment of the present disclosure, FIG. 14 is a schematic diagram illustrating an enclosure according to a tenth embodiment of the present disclosure, and FIGS. 15A and 15B are schematic diagrams illustrating an enclosure according to an eleventh embodiment of the present disclosure.

Referring to FIG. 13, partitions of the enclosure according to the ninth embodiment of the present disclosure are bent partitions provided to be bent in a '¬' shape or a '⊏' shape on one face of the enclosure.

The bent partitions tt and uu extend from a left face portion of the enclosure, and are provided to be bent in the '¬' shape or the '⊏' shape.

Speaker units 23 and 21 are disposed adjacent to the bent partition tt on the left face portion and a rear face portion of the enclosure, respectively, cross-sectional areas gradually decrease in a direction in which propagation of sound waves starting from the speaker units 21 and 23 travels, and each passage is formed asymmetrically.

The sound waves from the speaker units 21 and 23 pass through a lower portion of the bent partition tt, pass through a space provided by the bent partition tt and the bent partition uu, pass through a slot provided at an upper end portion of the bent partition uu, and sequentially pass through spaces formed by the bent partition uu and a top face portion 11, the bent partition uu and a right face portion, and the bent partition uu and a bottom face portion 15.

Referring to FIG. 14, it may be confirmed that an internal space of the enclosure is partitioned by a bent partition ww and a general partition vv.

A sound wave from a speaker unit 21 passes through a space provided by the bent partition ww having a '⊏' shape, and sequentially passes through spaces formed by the bent partition ww and a right face portion, the bent partition ww and a bottom face portion, the bent partition ww and the partition vv, and the partition vv and a left face portion.

A cross-sectional area gradually decreases in a direction in which propagation of a wound wave starting from the speaker unit 21 travels, and each passage is formed asymmetrically.

Referring to FIGS. 15A and 15B, in a partition xx, a bent partition having a '¬' shape extends from one face of the enclosure and bent partitions of which bent angles gradually increase are connected to each other. Therefore, the partition xx is provided in a spiral shape toward the center of the enclosure.

Referring to FIG. 15B, a speaker unit 21 is disposed at the center of a front face portion 13, and the front face portion may be provided in a square shape. A sound wave starting from the speaker unit 21 passes through a tunnel-type passage having a cross-sectional area that gradually decreases and formed asymmetrically.

According to the present disclosure, a space in the traveling direction of the sound wave in the internal space of the speaker has an asymmetrical structure rather than a symmetrical cross section, such an asymmetrical structure has a continuous dispersion effect for a sound pressure (sound wave) propagating in a traveling space of the sound wave and a reflected sound pressure (sound wave), and the dispersion effect for the sound pressure (sound wave) further suppresses excessive resonance of a specific frequency.

According to the present disclosure, a space in the traveling direction of the sound wave in the internal space of the speaker has an asymmetrical structure rather than a symmetrical cross section, such an asymmetrical structure has a continuous dispersion effect for a sound pressure (sound wave) propagating in a traveling space of the sound wave and a reflected sound pressure (sound wave), and the dispersion effect for the sound pressure (sound wave) further suppresses excessive resonance of a specific frequency.

The description of the present disclosure provided above is illustrative, and it is to be understood by those skilled in the art that various modifications and alterations may be made without departing from the spirit or essential feature of the present disclosure. Therefore, it is to be understood that the embodiments described above are illustrative rather than being restrictive in all aspects. For example, respective components described as a single form may be implemented in a distributed manner, and similarly, components described as being distributed may also be implemented in a combined form.

It is to be understood that the scope of the present disclosure will be defined by the claims rather than the description described above and all modifications and alterations derived from the claims and their equivalents fall within the scope of the present disclosure.

What is claimed is:

1. A speaker comprising:

an enclosure provided in a rectangular parallelepiped shape;

a speaker unit mounted on at least one face of the enclosure; and a partition provided inside the enclosure and partitioning a space, wherein the partition divides a space inside the enclosure, and a space starting from the speaker unit is provided as a space having an asymmetrical cross section of a tunnel structure;

wherein the partition includes at least one of a downward partition extending from a top face portion of the enclosure to a bottom face portion of the enclosure and an upward partition extending from the bottom face portion of the enclosure and provided toward the top face portion;

wherein the partition is disposed to have a preset angle with respect to a cross section generated when the enclosure is cut by a plane crossing a front face portion and a rear face portion of the enclosure, and positions of one end portion and the other end portion of the partition are different from each other when viewed in a plan view;

wherein when viewed in a plan view from the top of the enclosure, a length and a rotation angle of the one end portion of the partition are different from a length and a rotation angle of the other end portion of the partition.

2. The speaker of claim 1, wherein the other end portion of the partition is provided to correspond to a diagonal line of the top face portion of the enclosure when viewed in a plan view.

3. The speaker of claim 1, wherein in a case where a plurality of partitions are provided, the downward partition and the upward partition are alternately disposed in an axial direction perpendicular to a length direction of the enclosure.

4. The speaker of claim 1, wherein the partition is provided as a partition connecting one side of a top face portion of the enclosure and the other side of a bottom face portion of the enclosure to each other.

5. The speaker of claim 1, wherein the partition is a bent partition provided to be bent in a '¬' shape or a '⊏' shape on one face of the enclosure.

6. The speaker of claim 5, wherein each face of the bent partition is disposed to have a preset angle with respect to a cross section generated when the enclosure is cut by a plane crossing a front face portion and a rear face portion of the enclosure.

7. The speaker of claim 5, wherein the bent partition having the '¬' shape extends from one face of the enclosure, and the bent partitions of which bent angles gradually increase are connected to each other, such that the bent partition is provided in a spiral shape toward the center of the enclosure.

8. The speaker of claim 1, wherein the speaker unit is disposed on at least one of a top face portion of the enclosure and three faces adjacent to the top face portion according to a disposition form of the partition.

9. The speaker of claim 8, wherein the speaker unit is disposed on the center of any one face of the enclosure or is disposed to be biased from the center of any one face toward an end portion.

10. The speaker of claim 1, wherein a space starting from the speaker unit is formed to gradually decrease as a space having an asymmetric cross section of a tunnel structure.

* * * * *